US006878304B2

(12) United States Patent
Ogata et al.

(10) Patent No.: US 6,878,304 B2
(45) Date of Patent: Apr. 12, 2005

(54) REDUCTION RESISTANT THERMISTOR, METHOD OF PRODUCTION THEREOF, AND TEMPERATURE SENSOR

(75) Inventors: Itsuhei Ogata, Nishio (JP); Daisuke Makino, Nishio (JP); Kaoru Kuzuoka, Toyota (JP); Atsushi Kurano, Kuwana (JP)

(73) Assignees: Nippon Soken Inc., Aichi (JP); Denso Corporation, Kariya (JP)

( * ) Notice: Subject to any disclaimer, the term of this patent is extended or adjusted under 35 U.S.C. 154(b) by 113 days.

(21) Appl. No.: 09/925,017

(22) Filed: Aug. 9, 2001

(65) Prior Publication Data

US 2002/0036563 A1 Mar. 28, 2002

(30) Foreign Application Priority Data

Aug. 10, 2000 (JP) ..... 2000-242119
Jul. 5, 2001 (JP) ..... 2001-204217

(51) Int. Cl.[7] ..... H01C 7/10; H01C 7/13; B28B 1/00

(52) U.S. Cl. ..... 252/62.3; 252/62; 252/520.5; 252/518.1; 252/519.12; 252/519.15; 252/520.2; 338/22 R; 264/617

(58) Field of Search ..... 252/62.3 R, 520.5, 252/518.1, 519.12, 519.15, 520.2; 338/22 R, 22 SD; 264/614, 617; 29/610.1; 501/97.2, 134, 135, 136, 137; 423/595, 598, 599, 605, 606

(56) References Cited

U.S. PATENT DOCUMENTS 5,568,116 A 10/1996 Iwaya et al.
5,610,111 A 3/1997 Iwaya et al.
5,815,063 A * 9/1998 Goto et al. ..... 338/22 R
6,143,207 A * 11/2000 Yamada et al. ..... 252/518.1
6,164,819 A 12/2000 Moriwake et al.

FOREIGN PATENT DOCUMENTS

| | | | | |
|---|---|---|---|---|
| DE | 19908444 A1 | * | 9/1999 | ..... H01C/7/04 |
| EP | 0 001 511 | | 4/1979 | |
| EP | 0 626 356 | | 11/1994 | |
| EP | 0 655 752 | | 5/1995 | |
| EP | 0866472 A2 | * | 3/1998 | ..... H01C/7/02 |
| EP | 0 866 472 | | 9/1998 | |
| FR | 2 775 537 | | 9/1999 | |
| FR | 9902475 | * | 9/1999 | ..... H01C/7/04 |
| JP | 06325907 A | | 11/1994 | |
| JP | 07235405 A | | 9/1995 | |
| JP | 08259320 A | | 10/1996 | |
| JP | 09069417 A | | 3/1997 | |
| JP | 10154604 A | | 9/1998 | |
| JP | 10321048 | * | 12/1998 | ..... H01C/7/04 |
| JP | 2000012308 | * | 1/2000 | ..... H01C/7/04 |

* cited by examiner

*Primary Examiner*—Yogendra N. Gupta
*Assistant Examiner*—Kallambella M Vijayakumar
(74) *Attorney, Agent, or Firm*—Nixon & Vanderhye P.C.

(57) ABSTRACT

A highly accurate reduction resistant thermistor exhibiting stable resistance characteristics even under conditions where the inside of a metal case of a temperature sensor becomes a reducing atmosphere, wherein when producing the thermistor comprised of a mixed sintered body $(M1\ M2)O_3.AO_x$, the mean particle size of the thermistor material containing the metal oxide, obtained by heat treating, mixing, and pulverizing the starting materials, is made smaller than 1.0 $\mu$m and the sintered particle size of the mixed sintered body, obtained by shaping and firing this thermistor material, is made 3 $\mu$m to 20 $\mu$m so as to reduce the grain boundaries where migration of oxygen occurs, suppress migration of oxygen, and improve the reduction resistance.

13 Claims, 6 Drawing Sheets

REDUCTION RESISTANT THERMISTOR, METHOD OF PRODUCTION THEREOF, AND TEMPERATURE SENSOR

BACKGROUND OF THE INVENTION

1. Field of the Invention

The present invention relates to a reduction resistant thermistor able to detect temperature with a good accuracy over a broad temperature range and having characteristics stable even in a reducing atmosphere and a method of production of the same, more particularly relates to a temperature sensor for use in automobile emissions.

2. Description of the Related Art

A thermistor for use as a temperature sensor is used for measuring a broad range of temperatures from an intermediate temperature to a high temperature of about 400° C. to about 1300° C., that is, the temperature of automobile emissions, the temperature of the flame in gas-fired hot water heaters, and the temperature of heating furnaces. The characteristics of this type of thermistor are generally expressed by the resistance and resistance-temperature coefficient (temperature dependency of resistance). To handle the practical resistance of the temperature detection circuit forming part of a temperature sensor, it is required that the resistance of the thermistor be in a predetermined range (for example, a range of 100Ω to 100 kΩ in the range of the ordinary temperature of use). As a material having resistance characteristics suitable for a thermistor, a perovskite-based composite oxide material etc. is mainly used.

As a thermistor using a perovskite-based material, there is for example the one disclosed in Japanese Unexamined Patent Publication (Kokai) No. 6-325907. This discloses, as a thermistor able to be used in a broad temperature range, a thermistor exhibiting characteristics stable in a high temperature region obtained by mixing oxides of Y, Sr, Cr, Fe, Ti, etc. in a predetermined ratio and firing the mixture to obtain a complete solid solution.

Summarizing the problems to be solved by the invention, in the past, a temperature sensor for use in automobile emissions has had the sensing part, that is, the thermistor at the front end of the temperature sensor, covered by a metal case in order to prevent deposition of dust, soot, etc. from the sensed gas. When the emission becomes a high temperature of about 900° C., however, the metal case oxidizes due to the heat of the high temperature emission and the inside of the metal case easily becomes a reducing atmosphere. Therefore, there was the problem that the oxides comprising the thermistor were subjected to a reducing action and changed in resistance.

Therefore, usually, a temperature sensor is placed in an electric furnace and aged at 900 to 1000° C. for about 100 hours to stabilize the resistance. During use of a temperature sensor, however, if holes form in the metal case or the case warps etc. and therefore emission enters the case and the thermistor is exposed to a reducing atmosphere, the resistance is liable to change. Further, in recent engine control systems, the temperature sensor is mounted at a position nearer to the engine producing the high temperature emission. Therefore, the temperature sensor is exposed to the heat of higher temperature (for example, 1100 to 1200° C.) emission. With heat aging of 900 to 1000° C. for 100 hours, the metal case may reoxidize, the thermistor may be re-reduced, and the resistance may change depending on the operating mode of the engine. In this way, the problems have not been completely solved by heat aging. Further, there was the disadvantage that the number of production steps increased and therefore the temperature sensor became higher in cost.

On the other hand, Japanese Unexamined Patent Publication (Kokai) No. 9-69417 discloses to form a metal case from a special metal material, for example, an alloy mainly comprised of Ni—Cr—Fe, so as to suppress changes in the atmosphere in the case and reduce the change in resistance of the thermistor. Making the metal case from a special metal material, however, results in an increase in the cost of materials and the cost of processing. Further, the problem of the change in resistance when the thermistor itself is exposed to a reducing atmosphere remains unchanged.

In this way, a thermistor which exhibits a stable resistance characteristic even under conditions where the metal case of the temperature sensor becomes a reducing atmosphere has not been obtained yet.

SUMMARY OF THE INVENTION

An object of the present invention is to provide at a low cost a reduction resistant thermistor free from major changes in resistance even if exposed to a reducing atmosphere and having a high accuracy and superior stability of resistance.

Another object of the present invention is to provide a method of production of the above reduction resistant thermistor.

Still another object of the present invention is to provide a temperature sensor using the above reduction resistant thermistor.

According to a first aspect of the present invention, there is provided a reduction resistant thermistor comprised of a sintered body of a metal oxide obtained by shaping and firing a thermistor material including the metal oxide, having a mean particle size of the thermistor material of less than 1.0 μm, and having a mean sintered particle size of the sintered body of the metal oxide of 3 μm to 20 μm.

Preferably, the sintered body of the metal oxide is a mixed sintered body $(M1\ M2)O_3.AO_x$ of a composite oxide expressed by $(M1\ M2)O_3$ and a metal oxide expressed by $AO_x$, wherein, in the composite oxide $(M1\ M2)O_3$, M1 is at least one type of element selected from elements of Group IIA of the Periodic Table and Group IIIA except for La and M2 is at least one type of element selected from elements of Group IIIB, Group IVA, Group VA, Group VIA, Group VIIA, and Group VIII of the Periodic Table, the metal oxide $AO_x$ has a melting point of at least 1400° C., and the resistance (1000° C.) of the $AO_x$ alone in the shape of the thermistor is at least 1000Ω.

More preferably, when the molar fraction of the composite oxide $(M1\ M2)O_3$ in the mixed sintered body is a and the molar fraction of the metal oxide $AO_x$ is b, a and b satisfy the relations $0.05 \leqq a < 1$, $0 < b \leqq 0.95$, and $a+b=1$.

More preferably, M1 in the composite oxide $(M1\ M2)O_3$ is at least one type of element selected from Mg, Ca, Sr, Ba, Y, Ce, Pr, Nd, Sm, Eu, Gd, Tb, Dy, Ho, Yb, and Sc and M2 is at least one type of element selected from Al, Ga, Ti, Zr, Hf, V, Nb, Ta, Cr, Mo, W, Mn, Tc, Re, Fe, Co, Ni, Ru, Rh, Pd, Os, Ir, and Pt.

More preferably, A in the metal oxide $AO_x$ is at least one element selected from B, Mg, Al, Si, Ca, Sc, Ti, Cr, Mn, Fe, Ni, Zn, Ga, Ge, Sr, Y, Zr, Nb, Sn, Ce, Pr, Nd, Sm, Eu, Gd, Tb, Dy, Ho, Er, Tm, Yb, Lu, Hf, and Ta.

More preferably, the metal oxide $AO_x$ is at least one metal oxide selected from MgO, $Al_2O_3$, $SiO_2$, $Sc_2O_3$, $TiO_2$, $Cr_2O_3$, MnO, $Mn_2O_3$, $Fe_2O_3$, $Fe_3O_4$, NiO, ZnO, $Ga_2O_3$, $Y_2O_3$, $ZrO_2$, $Nb_2O_5$, $SnO_2$, $CeO_2$, $Pr_2O_3$, $Nd_2O_3$, $Sm_2O_3$, $Eu_2O$, $Gd_2O_3$, $Tb_2O_3$, $Dy_2O_3$, $Ho_2O_3$, $Er_2O_3$, $Tm_2O_3$, $Yb_2O_3$, $Lu_2O_3$, $HfO_3$, $Ta_2O_5$, $2MgO.2SiO_2$, $MgSiO_2$, $MgCr_2O_4$, $MgAl_2O_4$, $CaSiO_3$, $YAlO_3$, $Y_3Al_5O_{12}$, $Y_2SiO_5$, and $3Al_2O_3.2SiO_2$.

More preferably, M1 in the composite oxide $(M1\ M2)O_3$ is Y, M2 is Cr and Mn, A in the metal oxide $AO_x$ is Y, and the mixed sintered body $(M1\ M2)O_3.AO_x$ is expressed by $Y(CrMn)O_3.Y_2O_3$.

More preferably, the reduction resistant thermistor includes at least one of CaO, $CaCO_3$, $SiO_2$, and $CaSiO_3$ as a sintering aid.

According to a second aspect of the present invention, there is provided a method of production of a thermistor comprised of a sintered body of a metal oxide including a plurality of metal elements, comprising the steps of using powders of compounds of the plurality of metal elements as starting materials and mixing and pulverizing the powders to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

According to a third aspect of the present invention, there is provided a method of production of a thermistor comprised of a sintered body of a metal oxide including a plurality of metal elements, comprising the steps of using ultrafine particles or sol particles of compounds of the plurality of metal elements having mean particle sizes of not more than 0.1 μm as starting materials and mixing and pulverizing the ultrafine particles or sol particles to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

According to a fourth aspect of the present invention, there is provided a method of production of a thermistor comprised of a sintered body of a metal oxide, comprising the steps of preparing a precursor solution containing a precursor compound of the metal oxide, heat treating the precursor solution to obtain a thermistor material having a mean particle size of less than 1.0 μm, and shaping the thermistor material into a predetermined shape and firing it to obtain a sintered body having a mean sintered particle size of 3 μm to 20 μm.

According to a fifth aspect of the present invention, there is provided a method of production of a thermistor comprised of a sintered body of a metal oxide, comprising the steps of preparing a precursor solution containing a precursor compound of the metal oxide, adding and mixing ultrafine particles including the metal and having a mean particle size of not more than 0.1 μm into the precursor solution to prepare a precursor solution in which the ultrafine particles or sol particles are dispersed, heat treating the precursor solution in which the ultrafine particles or sol particles are dispersed to obtain a thermistor material having a mean particle size of less than 1.0 μm, and shaping the thermistor material into a predetermined shape and firing it to obtain a sintered body having a mean sintered particle size of 3 μm to 20 μm.

According to a sixth aspect of the present invention, there is provided a method of production of a thermistor comprised of a mixed sintered body $(M1\ M2)O_3.AO_x$ of a plurality of metal oxides, comprising the steps of preparing a first precursor solution containing a precursor compound of $(M1\ M2\ )O_3$, preparing a second precursor solution containing a precursor compound of $AO_x$, heat treating the first precursor solution to obtain a first thermistor material having a mean particle size of less than 1.0 μm, heat treating the second precursor solution to obtain a second thermistor material having a mean particle size of less than 1.0 μm, mixing the first and second thermistor materials, shaping the mixture into a predetermined shape, and firing it to obtain a sintered body having a mean sintered particle size of 3 μm to 20 μm.

According to a seventh aspect of the present invention, there is provided a temperature sensor comprised of one of the above reduction resistant thermistors.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
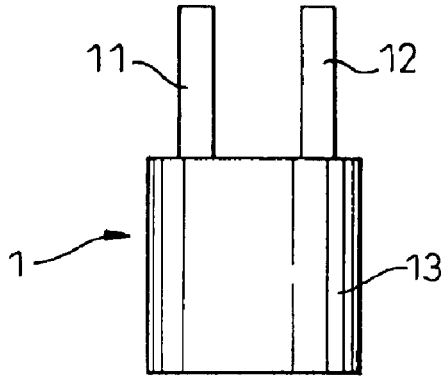
FIG. 1 is an overall schematic view of a thermistor to which the present invention is applied.

The inventors engaged in intensive studies to solve the above problems and as a result discovered that the sintered particle size of an oxide sintered body forming a thermistor is largely related to the migration of oxygen from the sintered body in a reducing atmosphere and that by making the sintered particle size a predetermined level, it was possible to reduce the grain boundaries where migration of oxygen occurs and therefore suppress migration of oxygen.

Claim 1 of the present invention was made based on this discovery and provides a reduction resistant thermistor comprised of a sintered body of a metal oxide obtained by shaping and firing a thermistor material including the metal oxide. Here, the thermistor material has a mean particle size of less than 1.0 μm, and the mean sintered particle size of the sintered body of the metal oxide is 3 μm to 20 μm.

The change in resistance of a conventional thermistor in a reducing atmosphere is considered to be due to the easy change in composition due the small for example 1 μm mean sintered particle size of the oxide sintered body of the thermistor and to the migration of oxygen from the grain boundaries. Therefore, in the present invention, use is made of a fine-grain material as the thermistor material to increase the sintered particle size of the obtained oxide sintered body and thereby reduce the grain boundaries where migration of the oxygen occurs. Specifically, if the mean sintered particle size is made one in the range of 3 μm to 20 μm, it is possible to suppress migration of oxygen and possible to suppress reduction of the thermistor even when exposed to a reducing atmosphere. To increase the mean sintered particle size, it is necessary to use a fine-grain material to facilitate particle growth. If a fine-grain material having a mean particle size of less than 1.0 μm is used and the firing conditions are controlled, it is possible to make the mean sintered particle size one within the above range. Further, by using a fine-grain material, it is possible to reduce the variations in composition of the oxide sintered body and reduce the variations in resistance to thereby increase the sensor accuracy.

In this way, since the thermistor of the present invention has reduction resistance and the resistance does not change by a large extent even if exposed to a reducing atmosphere, it is possible to detect the temperature with a good accuracy over a long period and realize a highly reliable temperature sensor. Further, there is no need to make the metal case out of an expensive special metal material and no heat aging is required either, so the cost can be reduced.

Further claim 1 relates to the composition of the thermistor. The sintered body of the metal oxide is made a mixed sintered body (M1 M2)$O_3$.$AO_x$ of a composite oxide expressed by (M1 M2)$O_3$ and a metal oxide expressed by $AO_x$. M1 in the composite oxide (M1 M2)$O_3$ is at least one type of element selected from elements of Group IIA of the Periodic Table and Group IIIA except for La, while M2 is at least one type of element selected from elements of Group IIIB, Group IVA, Group VA, Group VIA, Group VIIA, and Group VIII of the Periodic Table. The metal oxide $AO_x$ has a melting point of at least 1400° C., while the resistance (1000° C.) of the $AO_x$ alone in the shape of the thermistor is at least 1000 Ω.

For a temperature sensor for use in a broad temperature range, it is preferable to use a mixed sintered body of a composite oxide (M1 M2)$O_3$ of a perovskite structure having relatively low resistance characteristics in a temperature range of room temperature to 1000° C., and a metal oxide $AO_x$ having a high resistance and high melting point. Since the metal oxide $AO_x$ has a high resistance, it is possible to increase the resistance of the mixed sintered body in the high temperature region. Further, since the melting point is high and the heat resistance is superior, it is possible to increase the high temperature stability of the thermistor. Due to this, it is possible to obtain a wide range thermistor having a resistance in the temperature range of room temperature to 1000° C. in the range of 100Ω to 100 kΩ, having little change of resistance due to the heat history, and superior in stability.

Claim 2 relates to the molar ratio of the composite oxide (M1 M2)$O_3$ and the metal oxide $AO_x$ in the mixed sintered body. When the molar fraction of the composite oxide (M1 M2)$O_3$ in the mixed sintered body is a and the molar fraction of the metal oxide $AO_x$ is b, a and b are set to satisfy the relations $0.05 \leqq a < 1$, $0 < b \leqq 0.95$, and $a+b=1$. If the molar fractions a and b are in the above relations, the above effects (resistance in a predetermined range and stability of resistance) can be achieved more reliably.

Further, since the molar fractions can be changed over a broad range, it is possible to control the resistance and resistance-temperature coefficient in a broad range by suitably mixing and firing the (M1 M2)$O_3$ and $AO_x$.

Claim 3 relates to suitable examples of the metal elements in the composite oxide (M1 M2)$O_3$. In practice, it is preferable that M1 be at least one type of element selected from Mg, Ca, Sr, Ba, Y, Ce, Pr, Nd, Sm, Eu, Gd, Tb, Dy, Ho, Yb, and Sc and M2 be at least one type of element selected from Al, Ga, Ti, Zr, Hf, V, Nb, Ta, Cr, Mo, W, Mn, Tc, Re, Fe, Co, Ni, Ru, Rh, Pd, Os, Ir, and Pt.

Claim 4 relates to suitable examples of the metal oxide $AO_x$. As the metal element A, specifically at least one element selected from B, Mg, Al, Si, Ca, Sc, Ti, Cr, Mn, Fe, Ni, Zn, Ga, Ge, Sr, Y, Zr, Nb, Sn, Ce, Pr, Nd, Sm, Eu, Gd, Tb, Dy, Ho, Er, Tm, Yb, Lu, Hf, and Ta may be used.

As shown in claim 5, as the metal oxide $AO_x$, at least one metal oxide selected from MgO, $Al_2O_3$, $SiO_2$, $Sc_2O_3$, $TiO_2$, $Cr_2O_3$, MnO, $Mn_2O_3$, $Fe_2O_3$, $Fe_3O_4$, NiO, ZnO, $Ga_2O_3$, $Y_2O_3$, $ZrO_2$, $Nb_2O_5$, $SnO_2$, $CeO_2$, $Pr_2O_3$, $Nd_2O_3$, $Sm_2O_3$, $Eu_2O$, $Gd_2O_3$, $Tb_2O_3$, $Dy_2O_3$, $Ho_2O_3$, $Er_2O_3$, $Tm_2O_3$, $Yb_2O_3$, $Lu_2O_3$, $HfO_3$, $Ta_2O_5$, $2MgO.2SiO_2$, $MgSiO_2$, $MgCr_2O_4$, $MgAl_2O_4$, $CaSiO_3$, $YAlO_3$, $Y_3Al_5O_{12}$, $Y_2SiO_5$, and $3Al_2O_3.2SiO_2$ may be mentioned. These metal oxides all exhibit high resistance and high heat resistance and contribute to the improvement of the performance of a thermistor.

As shown in claim 6, M1 in the composite oxide (M1 M2)$O_3$ may be made Y, M2 Cr and Mn, A in the metal oxide $AO_x$ Y, and the mixed sintered body (M1 M2)$O_3$.$AO_x$ expressed by Y(CrMn)$O_3$.$Y_2O_3$. This mixed sintered body is suitable for use for a temperature sensor etc. and exhibits a high performance over a broad temperature range.

As shown in claim 7, a sintering aid may be added to the mixed sintered body (M1 M2)$O_3$.$AO_x$ to improve the sinterability of the particles. As the sintering aid, at least one of CaO, $CaCO_3$, $SiO_2$, and $CaSiO_3$ may be used. Due to this, a thermistor with a high sintering density is obtained.

Claim 8 provides a method of production of a thermistor comprised of a sintered body of a metal oxide including a plurality of metal elements comprising the steps of using powders of the compounds of the plurality of metal elements as starting materials and mixing and pulverizing the powders to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

The inventors engaged in studies on the process of production to reduce the migration of oxygen from the grain boundaries of the oxide sintered body forming the thermistor and as a result learned that in the step of preparing the materials of the thermistor, the mean particle size of a thermistor material comprised of a mixture of metal oxides was important. That is, if the material is made fine grained, particle growth becomes easier and the mean sintered particle size of the sintered body obtained can be increased. Therefore, first, the starting material is mixed and pulverized to less than 1.0 μm, then the mixture is heat treated, then again pulverized to obtain a thermistor material having a mean particle size of a small 1.0 μm or less. If this is shaped and the firing conditions are controlled, the mean sintered particle size can be increased to the range from 3 μm to 20 μm and a uniform sintered body having little variations in composition can be obtained. Therefore, it is possible to obtain a reduction resistant thermistor having stability of resistance in a reducing atmosphere and having little variation in the temperature accuracy.

Claim 9 provides another method of production of a thermistor comprised of a sintered body of a metal oxide including a plurality of metal elements, comprising the steps of using ultrafine particles or sol particles of compounds of the plurality of metal elements having mean particle sizes of not more than 0.1 μm as starting materials and mixing and pulverizing the ultrafine particles or sol particles to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

It is therefore possible to use ultrafine particles or sol particles having a particle size of not more than 0.1 μm as the starting materials and facilitate the reduction of the thermistor material to a fine grain.

Claim 10 provides another method of production of a thermistor comprised of a sintered body of a metal oxide, comprising the steps of preparing a precursor solution containing a precursor compound of the metal oxide, heat treating the precursor solution to obtain a thermistor material having a mean particle size of less than 1.0 μm, and shaping the thermistor material into a predetermined shape and firing it to obtain a sintered body having a mean sintered particle size of 3 μm to 20 μm.

It is therefore possible to heat treat a solution including a precursor of the above metal oxide to obtain a thermistor material. By using the solution method, it is possible to easily obtain a thermistor material reduced to a fine grain.

Claim 11 provides another method of production of a thermistor comprised of a sintered body of a metal oxide, comprising the steps of preparing a precursor solution containing a precursor compound of the metal oxide, adding and mixing ultrafine particles including the metal and having a mean particle size of not more than 0.1 μm into the precursor solution to prepare a precursor solution in which the ultrafine particles or sol particles are dispersed, heat treating the precursor solution in which the ultrafine particles or sol particles are dispersed to obtain a thermistor material having a mean particle size of less than 1.0 μm, and shaping the thermistor material into a predetermined shape and firing it to obtain a sintered body having a mean sintered particle size of 3 μm to 20 μm.

It is therefore possible to use both of a precursor compound of the metal oxide and ultrafine particles or sol particles of the metal oxide as the material of the thermistor to prepare a dispersion comprised of the precursor solution in which ultrafine particles or sol particles of the metal oxide are dispersed and heat treat this to obtain a thermistor material. A thermistor material reduced to a fine grain can also be easily obtained by this method.

Claim 12 provides a method of production of a thermistor comprised of a mixed sintered body $(M1\ M2)O_3.AO_x$ of a plurality of metal oxides, comprising the steps of preparing a first precursor solution containing a precursor compound of $(M1\ M2\ )O_3$, preparing a second precursor solution containing a precursor compound of $AO_x$, heat treating the first precursor solution to obtain a first thermistor material having a mean particle size of less than 1.0 μm, heat treating the second precursor solution to obtain a second thermistor material having a mean particle size of less than 1.0 μm, and mixing the first and second thermistor materials, shaping the mixture into a predetermined shape, and firing it to obtain a sintered body having a mean sintered particle size of 3 μm to 20 μm.

When the thermistor is comprised of a sintered body of a plurality of metal oxides, it is possible to separately prepare the metal oxides to obtain a plurality of thermistor materials reduced to a fine grain, mix them, then shape and fire the result. By this, it is possible to easily reduce the thermistor materials to a fine grain and prepare the composition of the mixed sintered body and possible to easily obtain a thermistor of the desired characteristics.

Claim 13 provides temperature sensor comprised of one of the reduction resistant thermistors of claim 1. A thermistor of the configuration of the above claim can detect temperature in a broad temperature range and has stable resistance characteristics, so it is possible to realize a temperature sensor of a high performance and superior reduction resistance.

Preferred embodiments of the present invention will be described in detail below while referring to the attached figures.

The reduction resistant thermistor of the present invention is a thermistor comprised of an oxide sintered body including a plurality of metal elements obtained by shaping and firing a thermistor material comprised of a powder including the plurality of metal elements. As the thermistor material, a fine-grain material having a mean particle size of less than 1.0 μm, preferably a fine-grain material having a mean particle size of not more than 0.5 μm, is used and the firing temperature and firing time are controlled to obtain a mean sintered particle size of the obtained metal oxide sintered body of 3 μm to 20 μm. The reduction resistant thermistor of the present invention reduces the migration of oxygen from the thermistor, that is, the oxide sintered body, in a reducing atmosphere, so increases the sintered particle size and reduces the grain boundaries where migration of oxygen occurs. By controlling the migration of oxygen, it is possible to greatly reduce the change in resistance of the thermistor.

If the mean particle size of the thermistor material is 1.0 μm or more, it is difficult to increase the mean sintered particle size and obtain the above desired range. Further, the composition of the sintered body varies and the temperature accuracy easily varies. If the mean sintered particle size of the metal oxide sintered body is smaller than 3 μm, the grain boundaries increase, the oxygen easily migrates, and reduction of the thermistor in a reducing atmosphere cannot be suppressed. If the mean sintered particle size is 3 μm or more, there is an effect of reduction of changes in resistance of the thermistor, but if the mean sintered particle size is too large, the variation in the temperature accuracy becomes greater. Therefore, the upper limit should be made 20 μm.

The oxide sintered body forming the reduction resistant thermistor of the present invention is preferably comprised of a mixed sintered body $(M1\ M2)O_3.AO_x$ obtained by mixing and firing a composite oxide expressed by $(M1\ M2)O_3$ and a metal oxide expressed by $AO_x$. Here, the composite oxide $(M1\ M2)O_3$ is a composite oxide having a perovskite structure, M1 is at least one type of element selected from elements of Group IIA of the Periodic Table and Group IIIA except for La, and M2 is at least one type of element selected from elements of Group IIIB, Group IVA, Group VA, Group VIA, Group VIIA, and Group VIII of the Periodic Table. Here, La is not used as M1 since it has a high hygroscopicity, reacts with the moisture in the atmosphere to form an unstable hydroxide, and causes problems such as breakage of the thermistor.

Specifically, the element of Group IIA forming M1 is selected from Mg, Ca, Sr, and Ba, while the element of Group IIIA is selected from Y, Ce, Pr, Nd, Sm, Eu, Gd, Tb, Dy, Ho, Yb, and Sc. Further, as the element of Group IIIB forming M2, for example, Al or Ga is used, as the element of Group IVA, for example, Ti, Zr, or Hf is used, as the element of Group VA, for example, V, Nb, or Ta is used, as the element of Group VIA, for example, Cr, Mo, or W is used, as the element of Group VIIA, for example, Mn, Tc, or Re is used, and as the element of Group VIII, for example, Fe, Co, Ni, Ru, Rh, Pd, Os, or Ir is used.

M1 and M2 may be combined in any way so as to obtain the desired resistance characteristics. A composite oxide $(M1\ M2)O_3$ comprised of suitably selected M1 and M2 exhibits a low resistance and low resistance-temperature coefficient (for example, 1000 to 4000 (K)). As such a composite oxide $(M1\ M2)O_3$, for example $Y(Cr,Mn)O_3$ is preferably used. Note that when selecting a plurality of elements as M1 or M2, the molar ratios of the elements may be suitably set in accordance with the desired resistance characteristics.

When using the composite oxide $(M1\ M2)O_3$ alone as the thermistor material, however, the stability of the resistance is insufficient. Further, the resistance in the high temperature region tends to become lower. In the present invention, therefore, a metal oxide $AO_x$ is mixed in and used as a material for stabilizing the resistance of the thermistor and adjusting it to the desire range. Therefore, as the characteristics required for the metal oxide $AO_x$, (1) a high resistance in the high temperature region and (2) a superior heat resistance and stability at a high temperature may be mentioned. Specifically, for (1), it is sufficient that the resistance of the $AO_x$ alone (not including $(M1\ M2)O_3$) at 1000° C. be at least 1000Ω in the dimensions and shape of an ordinary thermistor used as a sensor and, for (2), that the melting point be at least 1400° C. or sufficiently higher than the 1000° C. maximum temperature in usual use of a sensor.

To satisfy the characteristics of (1) and (2), the metal element A in the metal oxide $AO_x$ is preferably at least one element selected from B, Mg, Al, Si, Ca, Sc, Ti, Cr, Mn, Fe, Ni, Zn, Ga, Ge, Sr, Y, Zr, Nb, Sn, Ce, Pr, Nd, Sm, Eu, Gd, Tb, Dy, Ho, Er, Tm, Yb, Lu, Hf, and Ta. Specifically, as the metal oxide $AO_x$, at least one metal oxide selected from MgO, $Al_2O_3$, $SiO_2$, $Sc_2O_3$, $TiO_2$, $Cr_2O_3$, MnO, $Mn_2O_3$, $Fe_2O_3$, $Fe_3O_4$, NiO, ZnO, $Ga_2O_3$, $Y_2O_3$, $ZrO_2$, $Nb_2O_5$, $SnO_2$, $CeO_2$, $Pr_2O_3$, $Nd_2O_3$, $Sm_2O_3$, $Eu_2O$, $Gd_2O_3$, $Tb_2O_3$, $Dy_2O_3$, $Ho_2O_3$, $Er_2O_3$, $Tm_2O_3$, $Yb_2O_3$, $Lu_2O_3$, $HfO_3$, $Ta_2O_5$, $2MgO.2SiO_2$, $MgSiO_2$, $MgCr_2O_4$, $MgAl_2O_4$, $CaSiO_3$, $YAlO_3$, $Y_3Al_5O_{12}$, $Y_2SiO_5$, and $3Al_2O_3.2SiO_2$ may be used.

Preferably, as a metal oxide $AO_x$ having a high resistance and superior heat resistance, for example, $Y_2O_3$ may be mentioned. If Y is selected as M1 in the composite oxide $(M1\ M2)O_3$ and Cr and Mn are selected for M2, the mixed sintered body $(M1\ M2)O_3.AO_x$ is expressed by $Y(CrMn)O_3.Y_2O_3$. A thermistor comprised of this mixed sintered body is preferably used for a temperature sensor etc. and exhibits a high performance over a broad temperature range.

Next, the molar ratio of the composite oxide $(M1\ M2)O_3$ and metal oxide $AO_x$ in the mixed sintered body $(M1\ M2)O_3.AO_x$ will be explained. When the molar fraction of the composite oxide $(M1\ M2)O_3$ is a and the molar fraction of the metal oxide $AO_x$ is b, in the present invention, a and b preferably satisfy the relations $0.05<a\leqq 1$, $0<b\leqq 0.95$, and $a+b=1$. By suitably selecting a and b in this range, it is possible to realize the desired low resistance and low resistance-temperature coefficient. Since it is possible to change a and b in a broad range in this way, it is possible to control the resistance characteristics in various ways in a broad range.

Further, the mixed sintered body may include at least one of CaO, $CaCO_3$, $SiO_2$, and $CaSiO_3$ as a sintering aid. These sintering aids have the effect of forming liquid phases at the firing temperature of a mixture of a composite oxide $(M1\ M2)O_3$ and a metal oxide $AO_x$ to promote the sinterability. Due to this, the sintering density of the obtained mixed sintered body is improved, the resistance of the thermistor is stabilized, and variations in the resistance with respect to fluctuations of the firing temperature can be reduced. The amount of the sintering aid added is suitably adjusted in accordance with the type of the aid.

Figure 2A:
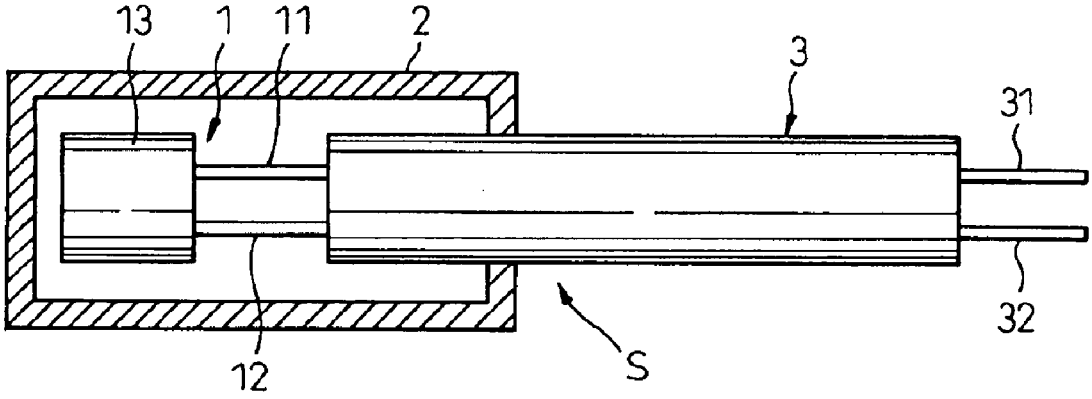
FIG. 2A is an overall schematic view of a temperature sensor incorporating the thermistor of the present invention.
Figure 2B:
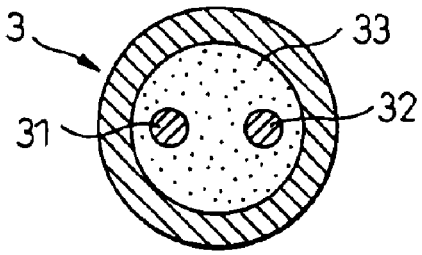
FIG. 2B is a sectional view along the line X—X in FIG. 2A.

FIGS. 1, 2A and 2B show examples of a thermistor 1 comprised of the above mixed sintered body and a temperature sensor S using the same. As shown in FIG. 1, the thermistor 1 is shaped with the ends of two parallel leads 11 and 12 embedded in the body 13. The above mixed sintered body is shaped into for example a cylinder of an outside diameter of 1.60 mm to form the body 13. This thermistor 1 is assembled into a general temperature sensor assembly shown in FIGS. 2A and 2B to form the temperature sensor S. As shown in FIG. 2A, the temperature sensor S has a tubular heat resistant metal case 2. The thermistor 1 is placed inside the left half. In the right half of the case 2 is positioned one end of a metal pipe 3 extending from the outside. The metal pipe 3, as shown in FIG. 2B, holds leads 31 and 32 inside it. These leads 31 and 32 pass through the inside of the metal pipe 3 to reach the metal case 2 where they are connected to the leads 11 and 12 of the thermistor 1 (FIG. 2A). The leads 11 and 12 for example have diameters of 0.3 mm and lengths of 5.0 mm and are made of Pt100 (pure platinum). Note that as shown in FIG. 2B, magnesia powder 33 is filled inside the metal pipe 3 to secure the insulation of the leads 31 and 32 inside the metal pipe 3.

Next, regarding the method of production of the above thermistor 1, the basic method of production (1) and the methods of production (2) to (5) obtained by modifying parts of the steps of the same will be shown. These methods of production differ in the form of the starting materials and method of preparation of the thermistor material, but all methods of production include a step of compounding and mixing the starting materials, a step of heat treatment, and a step of obtaining a fine-grain material having a mean particle size of less than 1.0 μm and shaping and firing this as the thermistor material and controlling the firing temperature and firing time at the firing step to obtain a thermistor having a mean sintered particle size of 3 μm to 20 μm.

In the basic method of production (1) (see FIG. 3), first powders of oxides of the metal elements for forming the materials of M1, M2, and A in the mixed sintered body $(M1\ M2)O_3.AO_x$ etc. are prepared and compounded to give the desired composition (first compounding step). Next, the compounded powders are mixed and pulverized by a medium agitating mill etc. with the addition of water or another dispersant, then dried by hot air to obtain a mixed powder of less than 1.0 μm (mixing step). This mixed powder is heat treated and pulverized to obtain a calcined powder of $(M1\ M2)O_3.AO_x$ of less than 1.0 μm (heat treatment step). The heat treatment temperature is usually made 1000 to 1700° C. or so. Further, as the materials of M1, M2, and A, it is also possible to use compounds other than oxides.

A sintering aid etc. is compounded into the calcined powder $(M1\ M2)O_3.AO_x$ in a predetermined ratio (first compounding step) and the result is mixed and pulverized by a medium agitating mill etc. with the addition of water or another dispersant to obtain a mixed slurry of a thermistor material having a mean particle size of less than 1.0 μm (mixing and pulverization step). This mixed slurry of the thermistor material is granulated and dried using a spray dryer etc. (granulation and drying step), molded into a predetermined shape incorporating leads comprised of Pt etc. (shaping step), then fired to obtain a reduction resistant thermistor comprised of a mixed sintered body (M1 M2)$O_3$.$AO_x$. In the firing step, the firing temperature is usually about 1400 to 1600° C. and the firing time 1 to 10 hours or so. By controlling the firing temperature and firing time, it is possible to obtain a mean sintered particle size of 3 μm to 20 μm.

In the shaping step, it is possible to shape the article by using a mold with leads inserted in advance and possible to shape the article, then make holes for insertion of the leads, insert the leads, then fire the article. Further, it is possible to connect the leads after firing. Alternatively, it is possible to mix and add a binder, resin material, etc. in the material of the thermistor to adjust it to a viscosity and hardness suitable for extrusion, extrude the article, and form holes for insertion of the leads to obtain a shaped article of the thermistor, insert the leads, then fire the article to obtain a thermistor formed with leads.

The method of production (2) changes part of the steps of the above basic method of production (1). In this method (see FIG. 4), as the starting material in the first compounding step, use is made of ultrafine particles or sol particles of metal compounds having a mean particle size of not more than 0.1 μm as materials of the M1, M2, and A in the mixed sintered body (M1 M2)$O_3$.$AO_x$. By using the ultrafine particles or sol particles in this way, it is possible to easily reduce the thermistor materials to a fine grain. Further, by compounding the ultrafine particles or sol particles of oxides of M1, M2, and A to obtain a desired composition and mixing, heat treating, and pulverizing the same, a thermistor material having a mean particle size of less than 1.0 μm is obtained. By similarly granulating, drying, shaping, and firing this thermistor material, a thermistor similarly having a mean sintered particle size of 3 μm to 20 μm is obtained.

Further, as shown in the method of production (3) (see FIG. 5), it is possible to make the starting materials in the first compounding step metal oxides forming the materials of M1, M2, and A in the mixed sintered body (M1 M2)$O_3$.$AO_x$ and shape a mixed solution of these metal oxides and citric acid or other complexing agent (dissolving and mixing step). If the metal oxides and complexing agent are made to react in a solution, a composite complex compound forming a precursor compound of the above mixed sintered body is obtained. This composite complex compound is heated to polymerize it using ethylene glycol or another polymerization agent to obtain a polymer of the composite complex agent (heating and polymerization step).

By heat treating this composite complex compound (heat treatment step), a thermistor material having a mean particle size (primary particle size) of less than 1.0 μm is obtained. By further mixing, pulverizing, and similarly granulating, drying, shaping, and firing this, a thermistor having a mean sintered particle size of 3 μm to 20 μm is obtained.

Further, as shown in the method of production (4) (see FIG. 6), it is possible to add ultrafine particles or sol particles of a metal compound containing A to a solution of a precursor compound containing the metal elements M1 and M2. In this method, first compounds of the metal elements M1 and M2, citric acid or another complexing agent, and ethylene glycol or another polymerization agent are compounded (first compounding step), a mixed solution of these metal compounds and citric acid or other complexing agent is formed (dissolving and mixing step), and the metal compounds and complexing agent are made to react in solution to obtain the composite complex compound forming the precursor compound of the mixed sintered body. Next, the composite complex compound is heated and made to polymerize to obtain a precursor solution containing a polymer of the composite complex compound. Ultrafine particles or sol particles of a compound of the metal element A having a mean particle size of not more than 0.1 μm are added to this precursor solution to give a desired composition (second compounding step) and mixed to prepare a precursor solution in which ultrafine particles or sol particles are dispersed (mixing step).

By heat treating the precursor solution in which the ultrafine particles or sol particles are dispersed (heat treatment step), a thermistor material having a mean particle size (primary particle size) of less than 1.0 μm is obtained. By mixing, pulverizing (mixing and pulverizing step) and similarly granulating, drying, shaping, and firing this, a thermistor having a mean sintered particle size of 3 μm to 20 μm is obtained.

Further, as shown in the method of production (5) (see FIG. 7), it is possible to separately prepare the composite oxide (M1 M2)$O_3$ and the metal oxide $AO_x$. In this method, the metal compounds forming the materials of M1 and M2 and the metal compound forming the material of A are compounded (first and second compounding steps) and the results mixed with citric acid or another complexing agent to form mixed solutions (first and second dissolving and mixing steps) and thereby obtain a composite complex compound forming a precursor compound of (M1 M2)$O_3$ and a complex compound forming a precursor compound of $AO_x$. Next, these complex compounds are heated and made to polymerize (first and second heating and polymerization steps) and then heated treated (heat treatment step) to obtain a powder material of (M1 M2)$O_3$ and a powder material of $AO_x$ having a mean particle size (primary particle size) of less than 1.0 μm.

By compounding these material powders to give a predetermined composition to obtain a thermistor material (third compounding step) and similarly mixing, pulverizing, granulating, drying, shaping, and firing the same, a thermistor having a mean sintered particle size of 3 μm to 20 μm is obtained.

The thermistor of the present invention obtained in this way is comprised of a mixed sintered body comprised of a composite oxide (M1 M2)$O_3$ and the metal oxide $AO_x$ mixed uniformly through grain boundaries. The mixed sintered body has a relatively large mean sintered particle size of 3 μm to 20 μm and is suppressed in migration of oxygen, so the thermistor has reduction resistance and will not be affected and changed in resistance even if the inside of the metal case becomes a reducing atmosphere. This thermistor exhibits a low resistance of from 100Ω to 100 kΩ required for a temperature sensor from room temperature (for example, 27° C.) to a high temperature region of 1000° C. or so and has a resistance-temperature coefficient β which can be adjusted within the range of 2000 to 4000 (K).

A temperature sensor incorporating this reduction resistant thermistor was used for a high temperature continuous durability test (in the atmosphere at 1100° C.) and measured for change in resistance. Here, since the reduction resistant thermistor is affected by the reducing atmosphere in the metal case due to the high temperature continuous durability test, the rate of change of resistance ΔR becomes an indicator for the stability of resistance of the reduction resistant thermistor. As a result, it was confirmed that even if the reduction resistant thermistor of the present invention is exposed to a reducing atmosphere in the metal case, the maximum rate of change of resistance ΔR can be stabilized at the level of 2 to 5% or so.

Further, the temperature accuracies of 100 temperature sensors using the reduction resistant thermistors of the present invention were evaluated. As a result, the temperature accuracy was an equivalent level before and after the durability test, that is, the initial temperature accuracy before the high temperature continuous durability test was a level of ±3 to 8° C. compared with a temperature accuracy after the durability test of a level of ±4 to 8° C. Accordingly, according to the reduction resistant thermistor of the present invention, it is possible to realize a highly accurate temperature sensor having a small rate of change of resistance ΔR and stable characteristics. Use of a case of an expensive, special metal material is unnecessary and the cost can be reduced.

EXAMPLE 1

As Example 1, a thermistor comprised of a mixed sintered body $aY(Cr_{0.5}Mn_{0.5})O_3.bY_2O_3$ selecting $Y(Cr_{0.5}Mn_{0.5})O_3$ for the composite oxide $(M1\ M2)O_3$ and $Y_2O_3$ for the metal oxide $AO_x$ is prepared. a and b are selected to give the desired resistance and resistance-temperature coefficient in the molar fractions of $Y(Cr_{0.5}Mn_{0.5})O_3$ and $Y_2O_3$. Here, a is made 0.38 and b is made 0.62. Further, in Example 1, as the starting materials, powders of oxides of the metal elements forming the mixed sintered body, that is, $Y_2O_3$, $Cr_2O_3$, and $Mn_2O_3$ were used. The steps of production of the thermistor of Example 1 will be explained next based on FIG. 3.

In the first compounding step, at least 99.9% pure $Y_2O_3$, $Cr_2O_3$, and $Mn_2O_3$ powders were prepared as the starting materials. These powders were weighed to give a composition after heat treatment (calcining) of $aY(Cr_{0.5}Mn_{0.5})O_3.bY_2O_3$ (a=0.38, b=0.62). Next, in the mixing step, the powders of these starting materials were mixed using a medium agitating mill to uniformly mix the materials. As the medium agitating mill, a ball mill (RV1V made by Ashizawa, effective volume: 1.0 liter, actual capacity: 0.5 liter) was used. 82% of the volume of the agitating tank was filled with zirconia ($ZrO_2$) as a pulverizing medium. A dispersant was added to the mixed material to suppress the agglomeration of the particles of the materials and the result was mixed and pulverized for 10 hours. The operating conditions were a peripheral speed of 12 m/sec and a rotational speed of 4000 rpm.

The mixed material slurry of the $Y_2O_3$, $Cr_2O_3$, and $Mn_2O_3$ obtained had a mean particle size of 0.2 μm. This mixed material slurry was dried by a spray dryer under conditions of an entrance temperature of the drying chamber of 200° C. and an exit temperature of 120° C. Next, in the heat treatment step, the dried mixed material was placed in a crucible made of 99.7% alumina ($Al_2O_3$) and calcined in a high temperature furnace in the atmosphere at 1100 to 1300° C. for 1 to 2 hours to obtain a calcined mass of $Y(Cr_{0.5}Mn_{0.5})O_3.Y_2O_3$. This calcined mass was roughly pulverized by a crusher, then passed through a 200 μm sieve.

Next, in the second compounding step, 4.5 wt % of $CaCO_3$ and 3 wt % of $SiO_2$ were added as sintering aids to the obtained calcined mass and the result was mixed and pulverized in the following mixing and pulverization step to obtain the thermistor material. For the mixing and pulverization, a medium agitating mill (ball mill) similar to that of the mixing step was used to obtain a uniform sintered particle size at the time of uniform mixing and sintering. Further, in the mixing and pulverization step, a dispersant, binder, and mold release agent were added and simultaneously pulverized. The mean particle size of the obtained thermistor material slurry was 0.2 μm.

In the granulating and drying step, the thus obtained thermistor material slurry was granulated and dried by a spray dryer to obtain granulated powder of $Y(Cr_{0.5}Mn_{0.5})O_3.Y_2O_3$. This granulated powder was used to prepare a thermistor 1 of a similar shape to that shown in the above FIG. 1. The shaping step was performed by molding. The leads 11 and 12 were made pure platinum (Pt100) ones with an outside diameter of 0.3 mm and a length of 5 mm. A mold of an outside diameter of 1.89 mm in which these were inserted was used for molding at a pressure of about 1000 $kgf/cm^2$ to thereby obtain a shaped article of an outside diameter of 1.9 mm in which leads were embedded.

The shaped article of the thermistor 1 obtained was arranged in the firing step in an $Al_2O_3$ corrugated setter and fired in the atmosphere at 1550° C. for 4 hours to obtain a sintered body having a sintered particle size of 8 μm. In this way, a thermistor 1 having an outside diameter of 1.6 mm comprised of a mixed sintered body $Y(Cr_{0.5}Mn_{0.5})O_3.Y_2O_3$ was obtained. This thermistor 1 was assembled into the general temperature sensor assembly shown in FIG. 2 to obtain a temperature sensor S.

Next, the temperature sensor S incorporating the thermistor 1 of Example 1 was inserted into a high temperature furnace, subjected to a high temperature continuous durability test in the atmosphere at 1100° C. for 1000 hours, and measured for change in resistance of the temperature sensor. The results are shown in Table 1. Here, the rate of change of resistance ΔR of Table 1 shows the change in resistance of the temperature sensor during the high temperature continuous durability test in the atmosphere at 1100° C. and is expressed by the following formula (1):

$$\Delta R(\%)=(RMAX_t/RINITIAL_t)\times 100-100 \quad (1)$$

where, in the formula, $RINITIAL_t$ is the initial resistance at a predetermined temperature t (for example, 600° C.), while $RMAX_t$ is the maximum resistance at the predetermined temperature t of the temperature sensor S when allowed to stand at 1100° C.

In this high temperature durability test, the thermistor 1 is affected by the reducing atmosphere in the metal case 2, so the rate of change of resistance ΔR becomes an indicator of the stability of resistance of the thermistor 1 of this example. From the results of Table 1, it could be confirmed that by the thermistor of Example 1, a maximum rate of change of resistance ΔR stabilized at the level of 2 to 5% or so can be realized even under conditions exposed to a reducing atmosphere such as in the metal case 2.

Further, after the high temperature continuous durability test, the temperature accuracies of 100 temperature sensors 100 were evaluated. The results are also given in Table 1. The method of evaluation of the temperature accuracy was to calculate the standard deviation σ of the resistance at 600° C. from the resistance-temperature data of the 100 temperature sensors, use the standard deviation σ times six as the amount of variation of the resistance (at both sides), convert the amount of variation of the resistance to temperature, halve that value to obtain a value A, and thereby obtain a temperature accuracy ±A° C.

As a result, as shown in Table 1, the thermistor of Example 1 had a temperature accuracy of ±5° C. after a high temperature continuous durability test at 1100° C. and 1000 hours. Note that the initial temperature accuracy of 100 temperature sensors before the durability test was ±5° C. so there was no change in the temperature accuracy before and after the durability test. In this way, the thermistor of the present invention is superior in reduction resistance and can maintain stable characteristics over a long time, so a case of an expensive special metal material is not required and it is possible to provide a low cost and highly accurate temperature sensor.

TABLE 1

| | Mean particle size of thermistor material (μm) | Sintered particle size of thermistor (μm) | Initial temperature accuracy (±° C., ±6σ) | Rate of change of resistance (%, maximum) | Temperature accuracy after 1100° C. durability test (±° C., ±6σ) |
|---|---|---|---|---|---|
| Ex. 1 | 0.2 | 8 | ±5 | 2 to 5 | ±5 |
| Ex. 2 | 0.2 | 10 | ±5 | 2 to 5 | ±5 |
| Ex. 3 | 0.2 | 20 | ±7 | 2 to 5 | ±7 |
| Ex. 4 | 0.1 | 6 | ±4 | 2 to 5 | ±4 |
| Ex. 5 | 0.1 | 12 | ±4 | 2 to 5 | ±4 |
| Ex. 6 | 0.1 | 20 | ±8 | 2 to 5 | ±8 |
| Ex. 7 | 0.1 | 3 | ±3 | 2 to 5 | ±5 |
| Ex. 8 | 0.1 | 7 | ±3 | 2 to 5 | ±4 |
| Ex. 9 | 0.1 | 20 | ±5 | 2 to 5 | ±5 |

EXAMPLE 2

Figure 3:
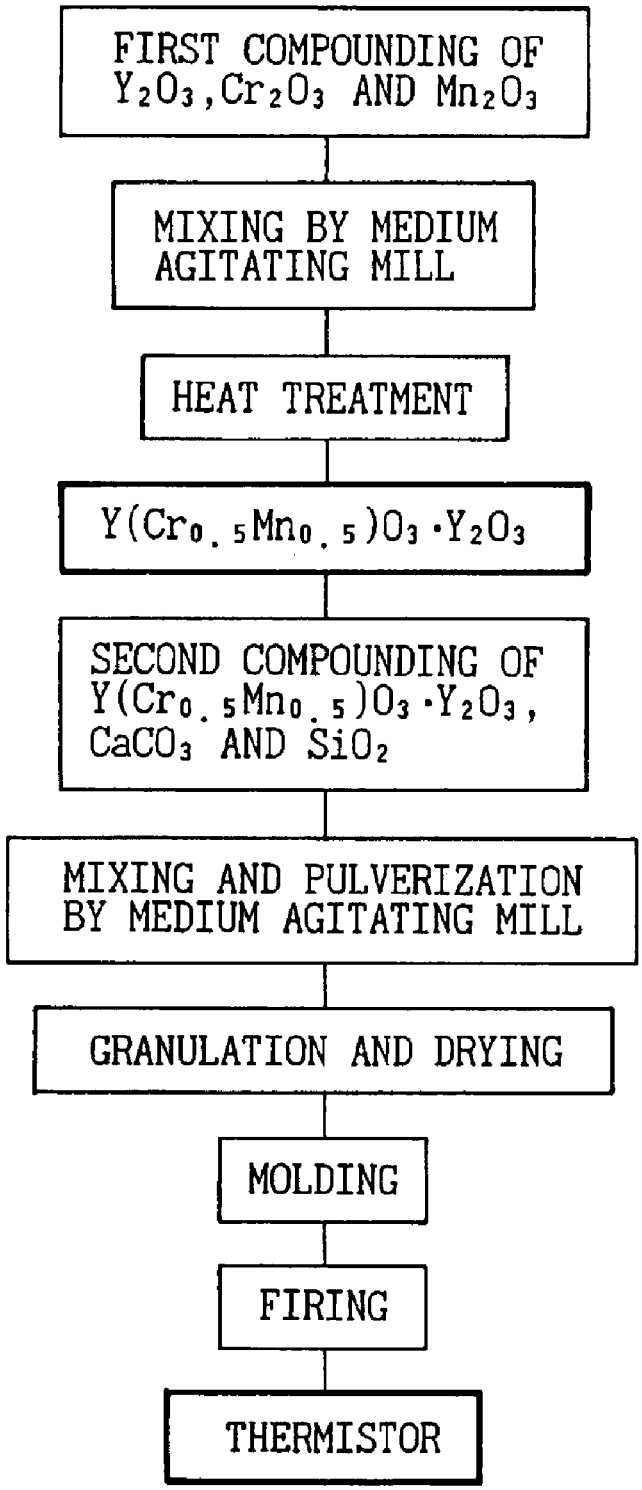
FIG. 3 is a flow chart of a process of production of a thermistor of a first embodiment according to a first method of production of the present invention.

In Example 2, a thermistor comprised of a mixed sintered body of the same composition as Example 1, that is, $aY(Cr_{0.5}Mn_{0.5})O_3.bY_2O_3$ (a=0.38, b=0.62) was prepared by changing just the firing conditions in the firing step in the production process shown in FIG. 3. The same method was used to obtain, granulate, dry, and shape a thermistor material of a mean particle size of 0.2 μm, then the firing conditions in the firing step were changed and the body fired in the atmosphere at 1550° C. for 6 hours to obtain a thermistor comprised of a mixed sintered body having a mean sintered particle size of 10 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 2. Further, a highly accurate thermistor having a temperature accuracy after the high temperature continuous durability test of ±5° C. and an initial temperature accuracy before the durability test of ±5° C. and superior in reduction resistance could be realized.

EXAMPLE 3

In Example 3, a thermistor comprised of a mixed sintered body of the same composition as Example 1, that is, $aY(Cr_{0.5}Mn_{0.5})O_3.bY_2O_3$ (a=0.38, b=0.62) was prepared by changing just the firing conditions in the firing step in the production process shown in FIG. 3. The same method was used to obtain, granulate, dry, and shape a thermistor material of a mean particle size of 0.2 μm, then the firing conditions in the firing step were changed and the body fired in the atmosphere at 1600° C. for 6 hours to obtain a thermistor comprised of a mixed sintered body having a mean sintered particle size of 20 μm.

A temperature sensor prepared using this thermistor was evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 3. Further, a highly accurate thermistor having a temperature accuracy after the high temperature continuous durability test of ±7° C. and an initial temperature accuracy before the durability test of ±7° C. and superior in reduction resistance could be realized.

EXAMPLE 4

Figure 4:
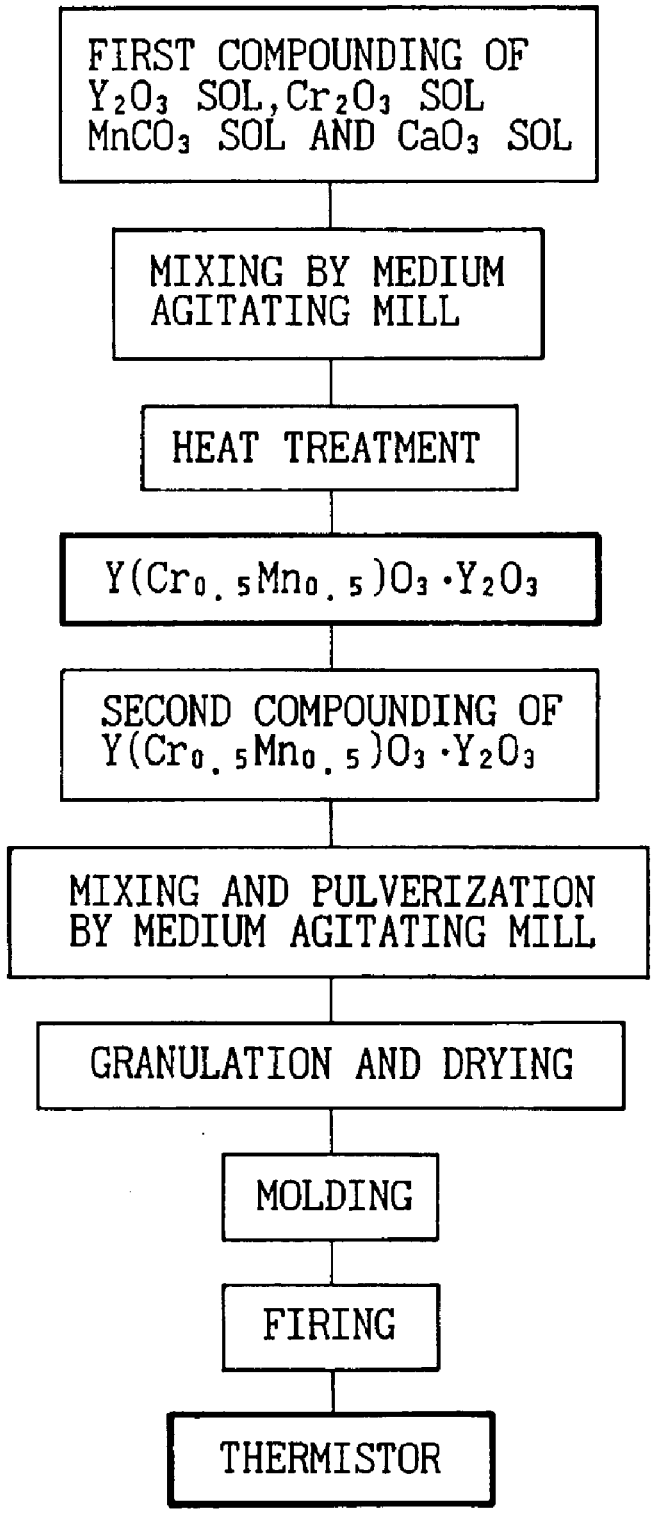
FIG. 4 is a flow chart of a process of production of a thermistor of a second embodiment according to a first method of production of the present invention.

Based on the process of production shown in FIG. 4, a thermistor comprised of a mixed sintered body of the same composition as Example 1, that is, $aY(Cr_{0.5}Mn_{0.5})O_3.bY_2O_3$ (a=0.38, b=0.62) was prepared. Example 4 differs from Examples 1 to 3 in the point of use of sol particles of oxides of the metal elements forming the mixed sintered body, that is, sol particles of $Y_2O_3$, sol particles of $Cr_2O_3$, and sol particles of $Mn_2CO_3$ as starting materials.

In the first compounding step, $Y_2O_3$ sol particles, $Cr_2O_3$ sol particles, and $Mn_2CO_3$ sol particles each having a purity of at least 99.9% and a mean particle size of not more than 0.1 μm and a sintering aid of $CaCO_3$ sol particles were prepared as starting materials. The $Y_2O_3$ sol particles, $Cr_2O_3$ sol particles, and $Mn_2CO_3$ sol particles were weighed to give the above target composition after heat treatment, then 4.5 wt % of the $CaCO_3$ sol particles was added to the target composition to prepare a mixed material.

This mixed material was mixed by a method similar to Example 1 to obtain a mixed material slurry containing $Y_2O_3$, $Cr_2O_3$, $Mn_2O_3$, and $CaCO_3$. The mean particle size of the obtained mixed material slurry was 0.1 μm. After this, heat treatment was performed similar to Example 1 to obtain a $Y(Cr_{0.5}Mn_{0.5})O_3.Y_2O_3$ calcined mass. This was further subjected to a mixing and pulverization step to obtain a thermistor material $Y(Cr_{0.5}Mn_{0.5})O_3.Y_2O_3$ having a mean particle size of 0.1 μm. This thermistor material was subjected to a granulating and drying step and a shaping step and then fired in the same way as in Example 1, that is, in the atmosphere at 1550° C. for 2 hours, to obtain a thermistor having a mean sintered particle size of 6 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. From Table 1, it could be confirmed that a maximum rate of change of resistance ΔR stabilized at the level of 2 to 5% or so could be realized by the thermistor of Example 4. Further, a highly accurate thermistor having a temperature accuracy after the high temperature continuous durability test of ±4° C. and an initial temperature accuracy before the durability test of ±4° C. and superior in reduction resistance could be realized.

EXAMPLE 5

In Example 5, a thermistor comprised of a mixed sintered body $aY(Cr_{0.5}Mn_{0.5})O_3.bY_2O_3$(a=0.38, b=0.62) was prepared using sol particles similar to those of Example 4 and changing just the firing conditions in the firing step shown in FIG. 4. The same procedure was followed as in Example 4 to obtain a thermistor material having a mean particle size of 0.1 μm. The same method was used to granulate, dry, and shape this, then this was fired in the atmosphere at 1600° C. for 2 hours to obtain a thermistor comprised of a mixed sintered body having a mean sintered particle size of 12 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 5. Further, a highly accurate thermistor having a temperature accuracy after the high temperature continuous durability test of ±4° C. and an initial temperature accuracy before the durability test of ±4° C. and superior in reduction resistance could be realized.

EXAMPLE 6

In Example 6, a thermistor comprised of a mixed sintered body $aY(Cr_{0.5}Mn_{0.5})O_3.bY_2O_3$ (a=0.38, b=0.62) was prepared using sol particles similar to those of Example 4 and changing just the firing conditions in the firing step shown in FIG. 4. The same procedure was followed as in Example 4 to obtain a thermistor material having a mean particle size of 0.1 μm. The same method was used to granulate, dry, and shape this, then this was fired in the atmosphere at 1650° C. for 2 hours to obtain a thermistor comprised of a mixed sintered body having a mean sintered particle size of 20 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 6. Further, a highly accurate thermistor having a temperature accuracy after the high temperature continuous durability test of ±8° C. and an initial temperature accuracy before the durability test of ±8° C. and superior in reduction resistance could be realized.

EXAMPLE 7

Figure 5:
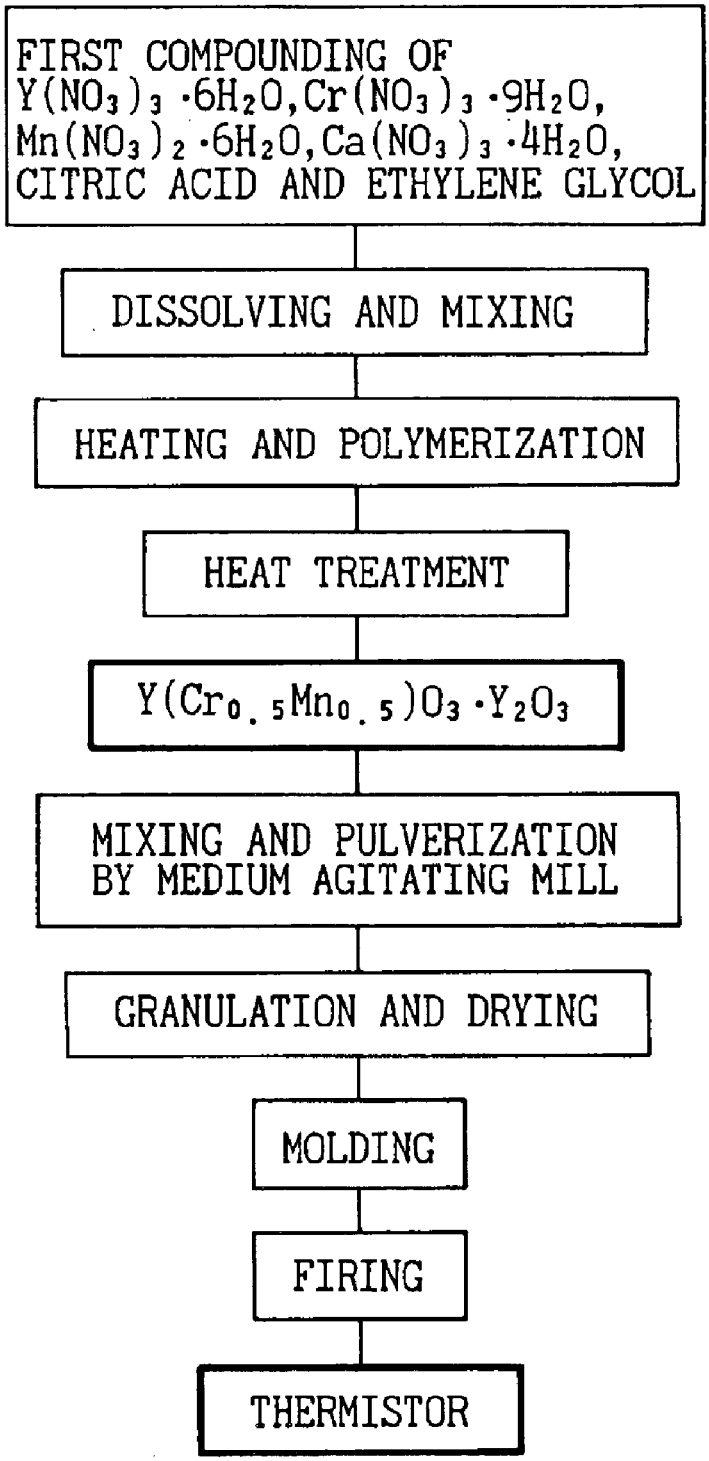
FIG. 5 is a flow chart of a process of production of a thermistor of a third embodiment according to a first method of production of the present invention.

Based on the process of production shown in FIG. 5, a thermistor comprised of a mixed sintered body of the same composition as Example 1, that is, $aY(Cr_{0.5}Mn_{0.5})O_3.bY_2O_3$ (a=0.38, b=0.62) was prepared. Example 7 differs from Examples 1 to 6 in the point of use of compounds of the elements comprising the mixed sintered body and shaping the precursor compound of the mixed sintered body by the solution method.

In the first compounding step, nitrate compounds of the metal elements were used to prepare at least 99.9% pure $Y(NO_3)_3.6H_2O$, $Cr(NO_3)_3.9H_2O$, and $Mn(NO_3)_2.6H_2O$. These were weighed to give the above target composition after heat treatment. Further, as the material of the sintering aid Ca, $Ca(NO_3)_2.4H_2O$ was used. This was weighed to become 4.5 wt % when converted to an oxide. Further, citric acid for forming a complexing agent and ethylene glycol serving as a polymerization agent were prepared. At this time, when the number of moles of the citric acid is c and the total amount of the metal elements Y, Cr, and Mn in the above target composition of the thermistor converted to number of moles is d, the citric acid was weighed to give a citric acid concentration of d/c=4 equivalents. This was dissolved in pure water to obtain a citric acid solution.

In the dissolving and mixing step, the above starting materials and $Ca(NO_3)_2.4H_2O$ were added to the citric acid solution and the metal element ions (ions of Y, Cr, Mn, and Ca) and citric acid were reacted to form a composite complex compound. Next, in the heating and polymerization step, a polymer of the composite complex compound was obtained by adding the polymerization agent ethylene glycol and agitating and mixing the result. After this, the obtained mixed solution was heated to 80 to 95° C. to advance the polymerization reaction. The heating was ended at the time when the polymerization reaction advanced sufficiently to thereby obtain a viscous solution of a precursor solution of $Y(Cr_{0.5}Mn_{0.5})O_3.Y_2O_3$. This precursor solution of $Y(Cr_{0.5}Mn_{0.5})O_3.Y_2O_3$ was placed in a 99.7% pure alumina crucible and dried, then was heated treated at 600 to 1200° C. to obtain a powder of a composition of $aY(Cr_{0.5}Mn_{0.5})O_3.bY202$ (a=0.38, b=0.62) and thereby obtain a thermistor material having a mean particle size (primary particle size) of 0.1 μm.

Next, the same procedure as in Example 1 was followed to mix, pulverize, granulate, dry, and shape the obtained thermistor material, then this was fired in the atmosphere at 1550° C. for 2 hours to obtain a thermistor comprised of a mixed sintered body having a mean sintered particle size of 3 μm. A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 7. Further, a highly accurate thermistor having a temperature accuracy after the high temperature continuous durability test of ±5° C. and an initial temperature accuracy before the durability test of ±3° C. and superior in reduction resistance could be realized.

EXAMPLE 8

In Example 8, a thermistor comprised of a mixed sintered body $aY(Cr_{0.5}Mn_{0.5})O_3.bY_2O_3$ (a=0.38, b=0.62) was prepared by a method similar to Example 7 changing just the firing conditions in the firing step shown in FIG. 5. The same procedure was followed as in Example 7 to obtain a thermistor material having a mean particle size of 0.1 μm. The same method was used to granulate, dry, and shape this, then this was fired in the atmosphere at 1600° C. for 2 hours to obtain a thermistor comprised of a mixed sintered body having a mean sintered particle size of 7 μm.

A temperature sensor incorporating this thermistor was prepared and evaluated in the same way as in Example 1.

The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 8. Further, a highly accurate thermistor having a temperature accuracy after the high temperature continuous durability test of ±4° C. and an initial temperature accuracy before the durability test of ±3° C. and superior in reduction resistance could be realized.

EXAMPLE 9

In Example 9, a thermistor comprised of a mixed sintered body $aY(Cr_{0.5}Mn_{0.5})O_3.bY_2O_3$ (a=0.38, b=0.62) was prepared by a method similar to Example 7 changing just the firing conditions in the firing step shown in FIG. 5. The same procedure was followed as in Example 7 to obtain a thermistor material having a mean particle size of 0.1 μm. The same method was used to granulate, dry, and shape this, then this was fired in the atmosphere at 1650° C. for 2 hours to obtain a thermistor comprised of a mixed sintered body having a mean sintered particle size of 20 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 1. As shown in Table 1, it could be confirmed that a maximum rate of change of resistance ΔR stabilized at the level of 2 to 5% or so could be realized even by the thermistor of Example 9. Further, a highly accurate thermistor having a temperature accuracy after the high temperature continuous durability test of ±5° C. and an initial temperature accuracy before the durability test of ±5° C. and superior in reduction resistance could be realized.

EXAMPLE 10

Figure 6:
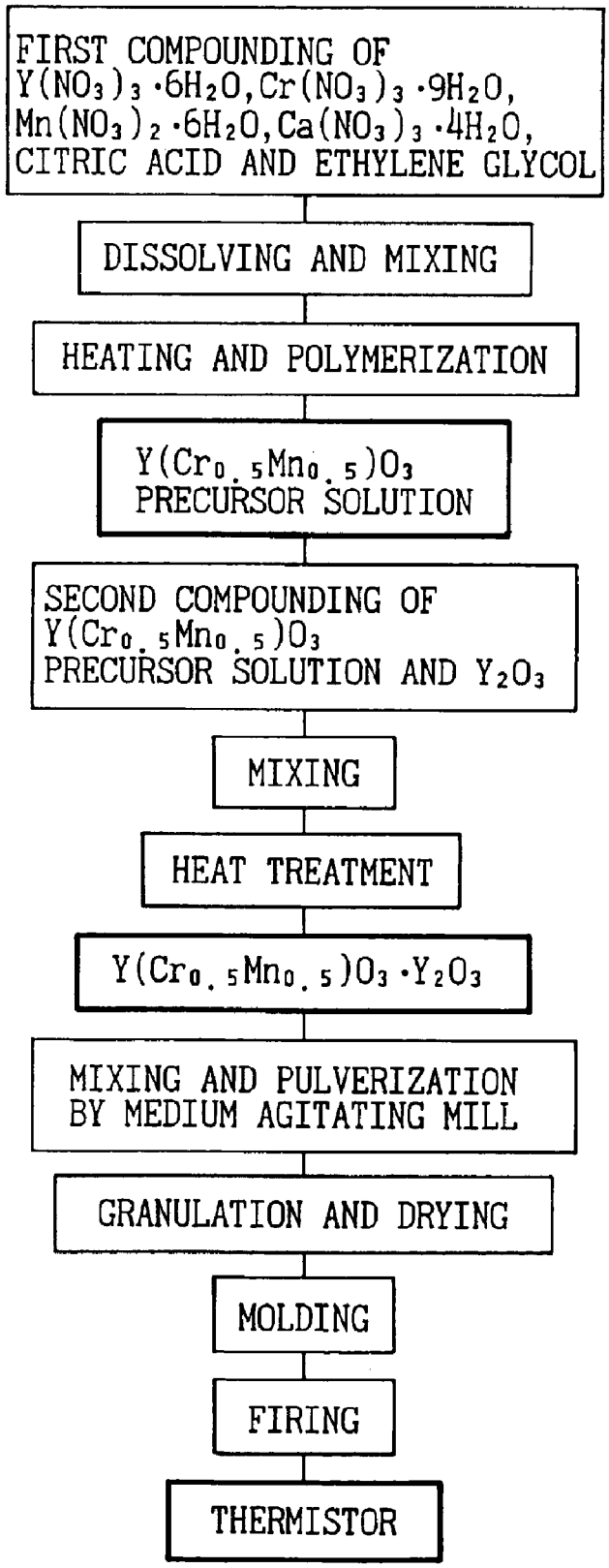
FIG. 6 is a flow chart of a process of production of a thermistor of a fourth embodiment according to a first method of production of the present invention.

Based on the process of production shown in FIG. 6, a thermistor comprised of a mixed sintered body of the same composition as Example 1, that is, $aY(Cr_{0.5}Mn_{0.5})O_3.bY_2O_3$ (a=0.38, b=0.62) was prepared. Example 10 differs from Examples 1 to 9 in the point of use of a solution of precursor compounds including the elements making up the composite oxide $Y(Cr_{0.5}Mn_{0.5})O_3$ and sol particles of the metal oxide $Y_2O_3$.

In the first compounding step, at least 99.9% pure $Y(NO_3)_3.6H_2O$, $Cr(NO_3)_3.9H_2O$, and $Mn(NO_3)_2.6H_2O$ were prepared as starting materials and were weighed to give $Y(Cr_{0.5}Mn_{0.5})O_3$ after heat treatment. Further, as the material of the sintering aid Ca, $Ca(NO_3)_2.4H_2O$ was used. This was weighed to become 4.5 wt % with respect to the $Y(Cr_{0.5}Mn_{0.5})O_3.Y_2O_3$. Further, a citric acid solution obtained by dissolving citric acid in pure water to give a citric acid concentration of d/c=4 equivalents when the number of moles of the citric acid is c and the total amount of the metal elements Y, Cr, and Mn of the $Y(Cr_{0.5}Mn_{0.5})O_3$ converted to number of moles is d and ethylene glycol serving as a polymerization agent were prepared.

In the dissolving and mixing step, the above starting materials and $Ca(NO_3)_2.4H_2O$ were added to the citric acid solution and the metal element ions (ions of Y, Cr, Mn, and Ca) and citric acid were reacted to form a composite complex compound. Next, in the heating and polymerization step, a polymer of the composite complex compound was obtained by adding the polymerization agent ethylene glycol and agitating and mixing the result. After this, the obtained mixed solution was heated to 80 to 95° C. to advance the polymerization reaction. The heating was ended at the time when the polymerization reaction advanced sufficiently to thereby obtain a viscous solution of a precursor solution of $Y(Cr_{0.5}Mn_{0.5})O_3$.

Next, in the second compounding step, metal oxide $Y_2O_3$ sol particles were compounded into the precursor solution of $Y(Cr_{0.5}Mn_{0.5})O_3$. At this time, in the mixing step, the $Y_2O_3$ sol particles were added and mixed into the precursor solution of $Y(Cr_{0.5}Mn_{0.5})O_3$ so that the composition after heat treatment became $aY(Cr_{0.5}Mn_{0.5})O_3.bY_2O_3$ (a=0.38, b=0.62) to thereby obtain a mixed solution of the precursor solution of $Y(Cr_{0.5}Mn_{0.5})O_3$ in which the $Y_2O_3$ sol particles were dispersed. In the heat treatment step, this mixed solution was placed in a 99.7% pure alumina crucible and dried, then was heated treated at 600 to 1200° C. to obtain a powder of the target composition for use as the thermistor material. The mean particle size (primary particle size) of this thermistor material was 0.08 μm.

Next, the same procedure as in Example 1 was followed to mix, pulverize, granulate, dry, and shape the obtained thermistor material, then this was fired in the atmosphere at 1550° C. for 2 hours to obtain a thermistor comprised of a mixed sintered body having a mean sintered particle size of 6 μm. A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 10. Further, a highly accurate thermistor having a temperature accuracy after the high temperature continuous durability test of ±4° C. and an initial temperature accuracy before the durability test of ±4° C. and superior in reduction resistance could be realized.

TABLE 2

| | Mean particle size of thermistor material (μm) | Sintered particle size of thermistor (μm) | Initial temperature accuracy (±° C., ±6σ) | Rate of change of resistance (%, maximum) | Temperature accuracy after 1100° C. durability test (±° C., ±6σ) |
|---|---|---|---|---|---|
| Ex. 10 | 0.08 | 6 | ±4 | 2 to 5 | ±4 |
| Ex. 11 | 0.08 | 12 | ±4 | 2 to 5 | ±4 |
| Ex. 12 | 0.08 | 20 | ±6 | 2 to 5 | ±6 |
| Ex. 13 | 0.06 | 5 | ±4 | 2 to 5 | ±4 |
| Ex. 14 | 0.06 | 8 | ±4 | 2 to 5 | ±4 |
| Ex. 15 | 0.06 | 20 | ±6 | 2 to 5 | ±6 |
| Ex. 16 | 0.5 | 4 | ±7 | 2 to 5 | ±7 |

EXAMPLE 11

In Example 11, a thermistor comprised of a mixed sintered body $aY(Cr_{0.5}Mn_{0.5})O_3.bY_2O_3$ (a=0.38, b=0.62) was prepared by using precursor compounds similar to Example 10 and $Y_2O_3$ sol particles and changing just the firing conditions in the firing step shown in FIG. 6. The same procedure was followed as in Example 10 to obtain a thermistor material having a mean particle size of 0.08 μm. The same method was used to granulate, dry, and shape this, then this was fired in the atmosphere at 1600° C. for 4 hours to obtain a thermistor comprised of a mixed sintered body having a mean sintered particle size of 12 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 11. Further, a highly accurate thermistor having a temperature accuracy after the high temperature continuous durability test of ±4° C. and an initial temperature accuracy before the durability test of ±4° C. and superior in reduction resistance could be realized.

EXAMPLE 12

In Example 12, a thermistor comprised of a mixed sintered body $aY(Cr_{0.5}Mn_{0.5})O_3.bY_2O_3$ (a=0.38, b=0.62) was prepared by using precursor compounds similar to Example 10 and $Y_2O_3$ sol particles and changing just the firing conditions in the firing step shown in FIG. 6. The same procedure was followed as in Example 10 to obtain a thermistor material having a mean particle size of 0.08 μm. The same method was used to granulate, dry, and shape this, then this was fired in the atmosphere at 1650° C. for 2 hours to obtain a thermistor comprised of a mixed sintered body having a mean sintered particle size of 20 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 12. Further, a highly accurate thermistor having a temperature accuracy after the high temperature continuous durability test of ±6° C. and an initial temperature accuracy before the durability test of ±6° C. and superior in reduction resistance could be realized.

EXAMPLE 13

Figure 7:
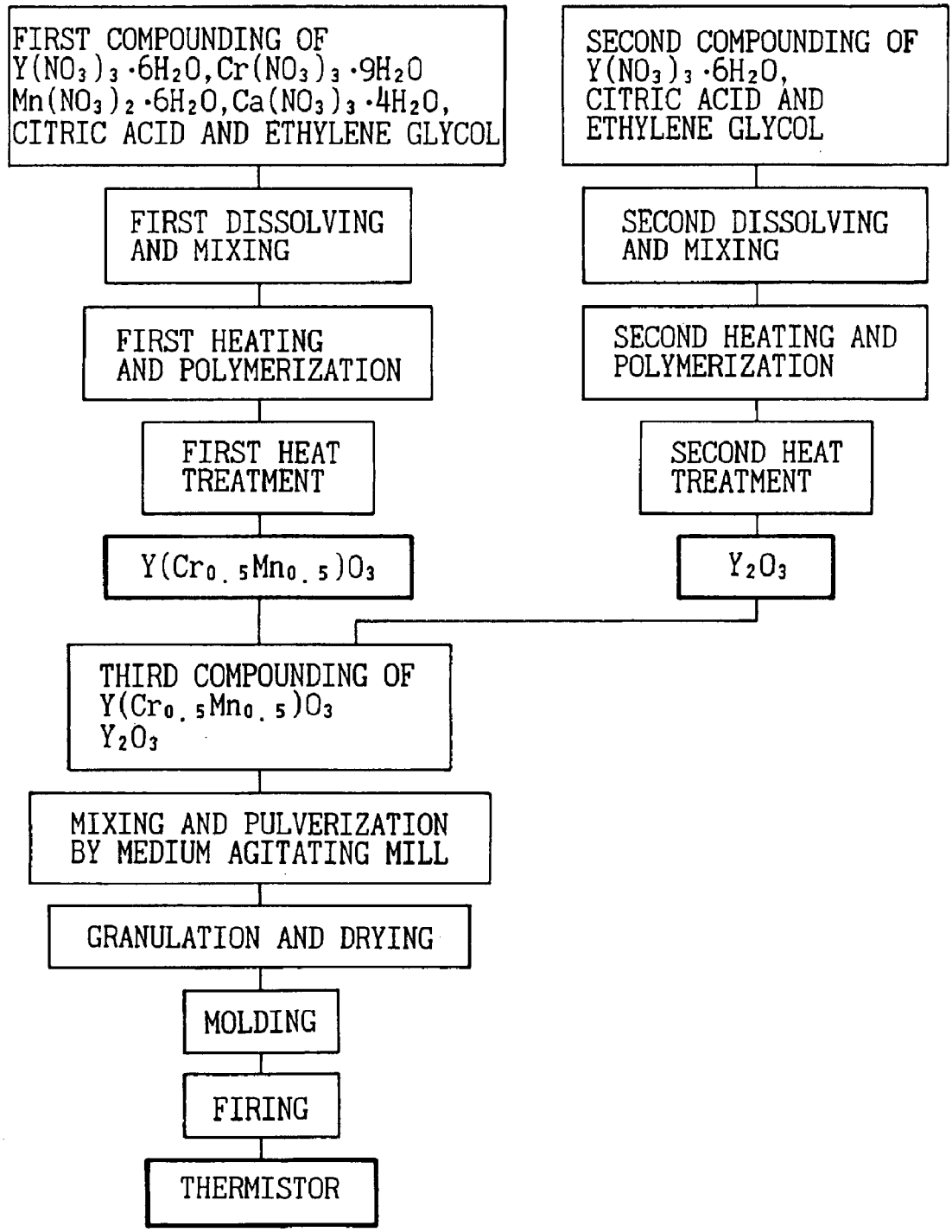
FIG. 7 is a flow chart of a process of production of a thermistor of a fifth embodiment according to a first method of production of the present invention.

Based on the process of production shown in FIG. 7, a thermistor comprised of a mixed sintered body of the same composition as Example 1, that is, $aY(Cr_{0.5}Mn_{0.5})O_3.bY_2O_3$ (a=0.38, b=0.62) was prepared. Example 13 differs from Examples 1 to 9 in the point of forming a precursor compound of the composite oxide $Y(Cr_{0.5}Mn_{0.5})O_3$ and a precursor compound of the metal oxide $Y_2O_3$ as the starting materials and mixing powder materials synthesized from these precursor compounds to obtain a thermistor material.

In the first compounding step, at least 99.9% pure $Y(NO_3)_3.6H_2O$, $Cr(NO_3)_3.9H_2O$, and $Mn(NO_3)_2.6H_2O$ were prepared as starting materials of the composite oxide $Y(Cr_{0.5}Mn_{0.5})O_3$ and were weighed to give $Y(Cr_{0.5}Mn_{0.5})O_3$ after heat treatment. Further, as the material of the sintering aid Ca, $Ca(NO_3)_2.4H_2O$ was used. This was weighed to become 4.5 wt % with respect to the finally obtained mixed sintered body $Y(Cr_{0.5}Mn_{0.5})O_3.Y_2O_3$. Next, citric acid was dissolved in pure water to give a citric acid concentration of d/c=4 equivalents when the number of moles of the citric acid is c and the total amount of the metal elements Y, Cr, and Mn of the $Y(Cr_{0.5}Mn_{0.5})O_3$ converted to number of moles is d to thereby obtain a citric acid solution. Further, ethylene glycol serving as a polymerization agent was prepared.

In the dissolving and mixing step, the above starting materials and $Ca(NO_3)_2.4H_2O$ were added to the citric acid solution and the metal element ions (ions of Y, Cr, Mn, and Ca) and citric acid were reacted to form a composite complex compound. Next, in the first heating and polymerization step, a polymer of the composite complex compound was obtained by adding the polymerization agent ethylene glycol and agitating and mixing the result. After this, the obtained mixed solution was heated to 80 to 95° C. to advance the polymerization reaction. The heating was ended at the time when the polymerization reaction advanced sufficiently to thereby obtain a viscous solution of a precursor solution of $Y(Cr_{0.5}Mn_{0.5})O_3$. In the first heat treatment step, this precursor solution of $Y(Cr_{0.5}Mn_{0.5})O_3$ was placed in a 99.7% pure alumina crucible and dried, then was heated treated at 600 to 1200° C. to obtain a powder material of $Y(Cr_{0.5}Mn_{0.5})O_3$ having a mean particle size of 0.08 μm.

On the other hand, in the second compounding step, a starting material of the metal oxide $Y_2O_3$, that is, at least 99.9% pure nitrate compound $Y(NO_3)_3.6H_2O$, was used as the starting material. Further, in the same way as the first compounding step, a citric acid solution and ethylene glycol serving as the polymerization agent were prepared. In the second dissolving and mixing step, the above starting material was added to the citric acid solution and the metal element ions (ions of Y) and citric acid were made to react to form a complex compound. Next, in the second heating and polymerization step, the polymerization agent ethylene glycol was added and stirred and mixed. After this, the obtained mixed solution was heated to 80 to 95° C. to advance the polymerization reaction. The heating was ended at the time when the polymerization reaction advanced sufficiently to thereby obtain a precursor solution of $Y_2O_3$. In the second heat treatment step, this precursor solution of $Y_2O_3$ was placed in a 99.7% pure alumina crucible and dried, then was heated treated at 600 to 1200° C. to obtain a powder material of $Y_2O_3$ having a mean particle size of 0.08 μm.

Next, in the third compounding step, the powder material of $Y(Cr_{0.5}Mn_{0.5})O_3$ and the powder material of $Y_2O_3$ were weighed to give $aY(Cr_{0.5}Mn_{0.5})O_3.bY_2O_3$ (a=0.38, b=0.62) to thereby obtain a thermistor material. The same procedure as in Example 1 was followed to mix, pulverize, granulate, dry, and shape the obtained thermistor material, then this was fired in the atmosphere at 1550° C. for 2 hours to obtain a thermistor comprised of a mixed sintered body having a mean sintered particle size of 5 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 13. Further, a highly accurate thermistor having a temperature accuracy after the high temperature continuous durability test of ±4° C. and an initial temperature accuracy before the durability test of ±4° C. and superior in reduction resistance could be realized.

EXAMPLE 14

In Example 14, a thermistor comprised of a mixed sintered body $aY(Cr_{0.5}Mn_{0.5})O_3.bY_2O_3$ (a=0.38, b=0.62) was prepared by using precursor compounds similar to Example 13 and changing just the firing conditions in the firing step shown in FIG. 7. The same procedure was followed as in Example 13 to obtain a thermistor material having a mean particle size of 0.08 μm. The same method was used to granulate, dry, and shape this, then this was fired in the atmosphere at 1600° C. for 4 hours to obtain a thermistor comprised of a mixed sintered body having a mean sintered particle size of 8 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 14. Further, a highly accurate thermistor having a temperature accuracy after the high temperature continuous durability test of ±4° C. and an initial temperature accuracy before the durability test of ±4° C. and superior in reduction resistance could be realized.

EXAMPLE 15

In Example 15, a thermistor comprised of a mixed sintered body $aY(Cr_{0.5}Mn_{0.5})O_3.bY_2O_3$ (a=0.38, b=0.62) was prepared by using precursor compounds similar to Example 13 and changing just the firing conditions in the firing step shown in FIG. 7. The same procedure was followed as in Example 13 to obtain a thermistor material having a mean particle size of 0.08 μm. The same method was used to granulate, dry, and shape this, then this was fired in the atmosphere at 1650° C. for 2 hours to obtain a thermistor comprised of a mixed sintered body having a mean sintered particle size of 20 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 15. Further, a highly accurate thermistor having a temperature accuracy after the high temperature continuous durability test of ±6° C. and an initial temperature accuracy before the durability test of ±6° C. and superior in reduction resistance could be realized.

EXAMPLE 16

In Example 16, a thermistor comprised of a mixed sintered body of the same composition as in Example 1, that is, $aY(Cr_{0.5}Mn_{0.5})O_3.bY_2O_3$ (a=0.38, b=0.62) was prepared. The same procedure was followed as in the process of production shown in FIG. 3 to mix and heat treat this, then this was mixed and pulverized to obtain a thermistor material having a mean particle size of 0.5 μm. The same method was used to granulate, dry, and shape this, then this was fired in the atmosphere at 1600° C. for 2 hours to obtain a thermistor comprised of a mixed sintered body having a mean sintered particle size of 4 μm.

A temperature sensor incorporating this thermistor was prepared and evaluated in the same way as in Example 1. The maximum rate of change of resistance ΔR, the temperature accuracy after a high temperature continuous durability test, and the initial temperature accuracy are shown in Table 2. As shown in Table 2, it could be confirmed that a maximum rate of change of resistance ΔR stabilized at the level of 2 to 5% or so could be realized even by the thermistor of Example 16. Further, a highly accurate thermistor having a temperature accuracy after the high temperature continuous durability test of ±7° C. and an initial temperature accuracy before the durability test of ±3° C. and superior in reduction resistance could be realized. In this way, if the mean particle size of the thermistor material is smaller than 1.0 μm, it is possible to obtain a sintered body having a mean sintered particle size of at least 3 μm and realize a highly accurate thermistor superior in reduction resistance.

COMPARATIVE EXAMPLES 1 to 3

For comparison, a thermistor comprised of a mixed sintered body of the same composition as in Example 1, that is, $aY(Cr_{0.5}Mn_{0.5})O_3.bY_2O_3$ (a=0.38, b=0.62) was prepared while changing only the firing conditions in the firing step of FIG. 3. The same procedure was followed as in FIG. 1 to obtain a thermistor material having a mean particle size of 0.2 μm. The same procedure was followed to granulate, dry, and shape this, then this was fired in the atmosphere at 1525° C. for 1 hour to obtain a thermistor comprised of a mixed sintered body having a mean sintered particle size of 1 μm (Comparative Example 1). Further, the firing conditions were changed to fire the material in the atmosphere at 1550° C. for 1 hour to obtain a thermistor comprised of a mixed sintered body having a mean sintered particle size of 2 μm (Comparative Example 2) and to fire the material in the atmosphere at 1680° C. for 2 hours to obtain a thermistor comprised of a mixed sintered body having a mean sintered particle size of 30 μm (Comparative Example 3).

A temperature sensor incorporating each of these thermistors was prepared and evaluated in the same way as in Example 1. The maximum rate of change of resistance ΔR, the temperature accuracy after a high temperature continuous durability test, and the initial temperature accuracy are shown in Table 3. As a result, the thermistors of Comparative Examples 1 and 2 having mean sintered particle sizes of less than 3 μm had large maximum rates of change of resistance ΔR of about 50 to 80%. Further, the temperature accuracy after the high temperature continuous durability test was ±12° C.—which is a large variation compared with the initial temperature accuracy before the durability test of ±5° C. Stable characteristics could not be obtained. On the other hand, the thermistor of Comparative Example 3 having a mean sintered particle size larger than 20 μm had a maximum rate of change of resistance ΔR of about 5 to 10%, but the initial temperature accuracy deteriorated to ±15° C., so as a result the temperature accuracy after the durability test was ±15° C., i.e., a highly accurate temperature sensor could not be obtained.

TABLE 3

| | Mean particle size of thermistor material (μm) | Sintered particle size of thermistor (μm) | Initial temperature accuracy (±° C., ±6σ) | Rate of change of resistance (%, maximum) | Temperature accuracy after 1100° C. durability test (±° C., ±6σ) |
|---|---|---|---|---|---|
| Comp. Ex. 1 | 0.2 | 1 | ±5 | 50 to 80 | ±12 |
| Comp. Ex. 2 | 0.2 | 2 | ±5 | 50 to 80 | ±12 |
| Comp. Ex. 3 | 0.2 | 30 | ±15 | 5 to 10 | ±15 |
| Comp. Ex. 4 | 0.05 | 1 | ±3 | 50 to 80 | ±12 |
| Comp. Ex. 5 | 0.05 | 2 | ±3 | 50 to 80 | ±11 |
| Comp. Ex. 6 | 0.05 | 30 | ±12 | 5 to 10 | ±12 |
| Comp. Ex. 7 | 1.0 | 2.5 | ±3 | 30 to 50 | ±11 |

COMPARATIVE EXAMPLES 4 to 6

For comparison, the same method as in Example 7 was used to prepare a thermistor comprised of a mixed sintered body of $aY(Cr_{0.5}Mn_{0.5})O_3.bY_2O_3$ (a=0.38, b=0.62). Based on the process of production of FIG. 5, the same procedure was followed as in Example 7 to heat treat this, then mix and pulverize it in a mixing and pulverization step to obtain a mean particle size of 0.05 μm. The same procedure was followed to granulate, dry, and shape this thermistor material, then this was fired in the atmosphere at 1525° C. for 1 hour to obtain a thermistor comprised of a mixed sintered body having a mean sintered particle size of 1 μm (Comparative Example 4). Further, the firing conditions were changed to fire the material in the atmosphere at 1550° C. for 1 hour to obtain a thermistor comprised of a mixed sintered body having a mean sintered particle size of 2 μm (Comparative Example 5) and to fire the material in the atmosphere at 1680° C. for 2 hours to obtain a thermistor comprised of a mixed sintered body having a mean sintered particle size of 30 μm (Comparative Example 6).

A temperature sensor incorporating each of these thermistors was prepared and evaluated in the same way as in Example 1. The maximum rate of change of resistance ΔR, the temperature accuracy after a high temperature continuous durability test, and the initial temperature accuracy are shown in Table 3. As a result, the thermistors of Comparative Examples 4 and 5 having mean sintered particle sizes of less than 3 μm had large maximum rates of change of resistance ΔR of about 50 to 80%. Further, the temperature accuracy after the high temperature continuous durability test was ±11° C. or ±12° C.—which is a large variation compared with the initial temperature accuracy before the durability test of ±3° C. Stable characteristics could not be obtained. On the other hand, the thermistor of Comparative Example 6 having a mean sintered particle size larger than 20 μm had a maximum rate of change of resistance ΔR of about 5 to 10%, but the initial temperature accuracy deteriorated to ±12° C., so as a result the temperature accuracy after the durability test was ±12° C., i.e., a highly accurate temperature sensor could not be obtained.

COMPARATIVE EXAMPLE 7

In Comparative Example 7, a thermistor comprised of a mixed sintered body of the same composition as Example 1, that is, $aY(Cr_{0.5}Mn_{0.5})O_3.bY_2O_3$ (a=0.38, b=0.62), was prepared. Starting materials the same as in Example 1 were used and the process of production shown in FIG. 3 was followed to mix these and heat treat, mix, and pulverize the mixture to thereby obtain a thermistor material having a mean particle size of 1.0 μm. The same procedure was followed as in Example 1 to granulate, dry, and shape this, then this was fired in the atmosphere at 1600° C. for 2 hours to obtain a thermistor comprised of a mixed sintered body having a mean sintered particle size of 2.5 μm.

A temperature sensor incorporating this thermistors was prepared and evaluated in the same way as in Example 1. The maximum rate of change of resistance ΔR, the temperature accuracy after a high temperature continuous durability test, and the initial temperature accuracy are shown in Table 3. As shown in Table 3, the thermistor of Comparative Example 7 had a large maximum rate of change of resistance ΔR of about 30 to 50%. Further, the temperature accuracy after the high temperature continuous durability test was ±11° C.—which is a large variation compared with the initial temperature accuracy before the durability test of ±3° C. Stable characteristics could not be obtained. In this way, when the mean particle size of the thermistor material is 1.0 μm or more, even if firing at a relatively high temperature and long time of 1600° C. and 2 hours, the mean sintered particle size of the mixed sintered body does not become more than 3 μm and a highly accurate temperature sensor superior in reduction resistance cannot be obtained.

In this way, the reduction resistant thermistor of the present invention has the mean particle size of the thermistor materials and the mean sintered particle size of the mixed sintered body controlled to predetermined ranges, so is reduced in migration of oxygen from the grain boundaries of the sintered body, suppressed in reduction of the thermistor, and suppressed in changes of resistance. Therefore, there is no need such as in the past for heat aging for stabilizing the resistance of the thermistor or for use of a case of an expensive metal material and a highly accurate thermistor having a small rate of change of resistance ΔR and stable characteristics can be realized at a low cost.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2000-242119, filed on Aug. 10, 2000, and Japanese Patent Application No. 2001-

204217, filed on Jul. 5, 2001, the disclosure of which is expressly incorporated herein by reference in its entirety.

What is claimed is:

1. A thermistor having durability against a reducing atmosphere comprised of a sintered body of a metal oxide obtained by shaping and firing a thermistor material, the metal oxide having a mean particle size of the thermistor material of less than 1.0 μm, and having a mean sintered particle size of the sintered body of the metal oxide of 3 μm to 20 μm, wherein the sintered body of the metal oxide is a mixed sintered body $(M1\ M2)O_3.AO_x$ of a composite oxide $(M1\ M2)O_3$ having a provskite structure and a metal oxide $AO_x$, wherein, in the composite oxide $(M1\ M2)O_3$, M1 is at least one element selected from elements of Group IIA of the Periodic Table and Group IIIA except for La and M2 is at least one element selected from elements of Group IIIB, Group IVA, Group VA, Group VIA, Group VIIA, and Group VIII of the Periodic Table, the metal oxide $AO_x$ having a melting point of at least 1400° C., and a resistance (1000° C.) of the $AO_x$ alone in the shape of the thermistor is at least 1000Ω.

2. A thermistor having durability against a reducing atmosphere as set forth in claim 1, wherein the molar fraction of the composite oxide $(M1\ M2)O_3$ in the mixed sintered body is a and the molar fraction of the metal oxide $AO_x$ is b, a and b satisfy the relations $0.05a \leqq 1$, $0<b \leqq 0.95$, and $a+b=1$.

3. A thermistor having durability against a reducing atmosphere as set forth in claim 1, wherein M1 in the composite oxide $(M1\ M2)O_3$ is at least one element selected from Mg, Ca, Sr, Ba, Y, Ce, Pr, Nd, Sm, Eu, Gd, Tb, Dy, Ho, Yb, and Sc and M2 is at least one element selected from Al, Ga, Ti, Zr, Hf, V, Nb, Ta, Cr, Mo, W, Mn, Tc, Re, Fe, Co, Ni, Ru, Rh, Pd, Os, Ir, and Pt.

4. A thermitor having durability against a reducing atmosphere as set forth in claim 1, wherein A in the metal oxide $AO_x$ is at least one element selected from B, Mg, Al, Si, Ca, Sc, Ti, Cr, Mn, Fe, Ni, Zn, Ga, Ge, Sr, Y, Zr, Nb, Sn, Ce, Pr, Nd, Sm, Eu, Gd, Tb, Dy, Ho, Er, Tm, Yb, Lu, Hf, and Ta.

5. A thermistor having durability against a reducing atmosphere as set forth in claim 1, wherein the metal oxide $AO_x$ is at least one metal oxide selected from MgO, $Al_2O_3$, $SiO_2$, $Sc_2O_3$, $TiO_2$, $Cr_2O_3$, MnO, $Mn_2O_3$, $Fe_2O_3$, $Fe_3O_4$, NiO, ZnO, $Ga_2O_3$, $Y_2O_3$, $ZrO_2$, $Nb_2O_5$, $SnO_2$, $CeO_2$, $Pr_2O_3$, $Nd_2O_3$, $Sm_2O_3$, $Eu_2O$, $Gd_2O_3$, $Tb_2O_3$, $Dy_2O_3$, $Ho_2O_3$, $Er_2O_3$, $Tm_2O_3$, $Yb_2O_3$, $Lu_2O_3$, $HfO_3$, $Ta_2O_5$, $2MgO.2SiO_2$, $MgSiO_2$, $MgCr_2O_4$, $MgAl_2O_4$, $CaSiO_3$, $YAlO_3$, $Y_3Al_5O_{12}$, $Y_2SiO_5$, and $3Al_2O_3.2SiO_2$.

6. A thermistor having durability against a reducing atmosphere as set forth in claim 1, wherein M1 in the composite oxide $(M1\ M2)O_3$ is Y, M2 is Cr and Mn, A in the metal oxide $AO_x$ is Y, and the mixed sintered body $(M1\ M2)O_3.AO_x$ is $Y(CrMn)O_3.Y_2O_3$.

7. A thermistor having durability against a reducing atmosphere as set forth in claim 1, including at least one of CaO, $CaCO_3$, $SiO_2$, and $CaSiO_3$ as a sintering aid.

8. A temperature sensor comprised of a thermistor having durability against a reducing atmosphere as set forth in claim 1.

9. A method of production of a thermistor comprised of a sintered body of a metal oxide including a plurality of metal elements, comprising the steps of:

using powders of compounds of the plurality of metal elements as starting materials and mixing and pulverizing the powders to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

10. A method of production of a thermistor comprised of a sintered body of a metal oxide including a plurality of metal elements, comprising the steps of:

using ultrafine particles or sol particles of compounds of the plurality of metal elements having mean particle sizes of not more than 0.1 μm as starting materials and mixing and pulverizing the ultrafine particles or sol particles to obtain a mixture having a mean particle size of less than 1.0 μm, heat treating the mixture, then pulverizing it to obtain a thermistor material having a mean particle size of less than 1.0 μm, and shaping the thermistor material into a predetermined shape and firing it to obtain a sintered body having a mean sintered particle size of 3 μm to 20 μm.

11. A method of production of a thermistor comprised of a sintered body of a metal oxide, comprising the steps of:

preparing a precursor solution containing a precursor compound of the metal oxide, heat treating the precursor solution to obtain a thermistor material having a mean particle size of less than 1.0 μm, and shaping the thermistor material into a predetermined shape and firing it to obtain a sintered body having a mean sintered particle size of 3 μm to 20 μm.

12. A method of production of a thermistor comprised of a sintered body of a metal oxide, comprising the steps of:

preparing a precursor solution containing a precursor compound of the metal oxide, adding and mixing ultrafine particles including the metal and having a mean particle size of not more than 0.1 μm into the precursor solution to prepare a precursor solution in which the ultrafine particles or sol particles are dispersed, heat treating the precursor solution in which the ultrafine particles or sol particles are dispersed to obtain a thermistor material having a mean particle size of less than 1.0 μm, and shaping the thermistor material into a predetermined shape and firing it to obtain a sintered body having a mean sintered particle size of 3 μm to 20 μm.

13. A method of production of a thermistor comprised of a mixed sintered body $(M1\ M2)O_3.AO_x$ of a plurality of metal oxides, comprising the steps of:

preparing a first precursor solution containing a precursor compound of $(M1\ M2)O_3$, preparing a second precursor solution containing a precursor compound of $AO_x$, heat treating the first precursor solution to obtain a first thermistor material having a mean particle size of less than 1.0 μm, heat treating the second precursor solution to obtain a second thermistor material having a mean particle size of less than 1.0 μm, and mixing the first and second thermistor materials, shaping the mixture into a predetermined shape, and firing it to obtain a sintered body having a mean sintered particle size of 3 μm to 20 μm.

* * * * *